US012410702B2

(12) United States Patent
Canning et al.

(10) Patent No.: US 12,410,702 B2
(45) Date of Patent: Sep. 9, 2025

(54) TOE SLEEVES AND METHODS OF USE

(71) Applicant: Halliburton Energy Services, Inc., Houston, TX (US)

(72) Inventors: Sean Canning, Carrollton, TX (US); Joseph Ray Collins, Carrollton, TX (US); Daniel Keith Moeller, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1 day.

(21) Appl. No.: 18/417,222

(22) Filed: Jan. 19, 2024

(65) Prior Publication Data

US 2025/0237135 A1 Jul. 24, 2025

(51) Int. Cl.
*E21B 47/06* (2012.01)
*E21B 34/06* (2006.01)

(52) U.S. Cl.
CPC ..... *E21B 47/06* (2013.01); *E21B 34/063* (2013.01); *E21B 2200/08* (2020.05)

(58) Field of Classification Search
CPC .. E21B 2200/08; E21B 23/06; E21B 33/1208; E21B 34/063; E21B 2200/06; E21B 33/134; E21B 34/14; E21B 17/1078; E21B 33/126; E21B 43/10; E21B 41/0035
See application file for complete search history.

(56) References Cited

U.S. PATENT DOCUMENTS 11,313,203 B2 4/2022 Walton et al.
2019/0078408 A1* 3/2019 Fripp ..... E21B 23/06

FOREIGN PATENT DOCUMENTS

CA 2851710 A1 * 4/2013 ..... E21B 23/004
GB 2615099 A * 8/2023 ..... E21B 33/13

OTHER PUBLICATIONS

English translation of CN 111201368. (Year: 2020).*

* cited by examiner

*Primary Examiner* — Zakiya W Bates
(74) *Attorney, Agent, or Firm* — Conley Rose, P.C.; Rodney B. Carroll

(57) ABSTRACT

Exemplary toe sleeve embodiments, for example for hydrocarbon wellbore casing, can have a closure mechanism with at least two different operations for opening. For example, the closure mechanism may include a degradable element and a non-degradable element. The degradable element may be configured to maintain closure of the toe sleeve during pressure testing, while the non-degradable element may be rated to open at a lower pressure once the degradable element has degraded. This approach may allow effective pressure testing of the casing, while ensuring that the toe sleeve can be opened effectively without risk of damage to the casing.

20 Claims, 7 Drawing Sheets

TOE SLEEVES AND METHODS OF USE

FIELD

The present disclosure relates generally to the field of hydrocarbon wells, and more particularly to toe sleeves for hydrocarbon wells.

BACKGROUND

To produce hydrocarbons (for example, oil, gas, etc.) from a subterranean formation, wellbores may be drilled that penetrate hydrocarbon-containing portions of the subterranean formation. The portion of the subterranean formation from which hydrocarbons may be produced is commonly referred to as a "production zone." In some instances, a subterranean formation penetrated by the wellbore may have multiple production zones at various locations along the wellbore.

Generally, after a wellbore has been drilled to a desired depth, completion operations are performed. Such completion operations may include inserting a liner or casing into the wellbore and, at times, cementing the casing or liner into place. For example, various downhole tools may be inserted into the wellbore to extract the natural resources such as hydrocarbons or water from the wellbore, to inject fluids into the wellbore, and/or to maintain the wellbore. It is common practice in completing oil and gas wells to set a string of pipe, known as a casing string, in the wellbore and often to cement around the outside of the casing to isolate the various formations penetrated by the well. The casing string may include various wellbore tools.

After cementing of the casing is complete, the bottom of the wellbore typically is re-opened to establish fluid communication between the hydrocarbon-bearing formations and the interior (e.g. bore) of the casing. It often may be desirable to test the integrity of the casing prior to re-opening the wellbore. Casing integrity testing and re-opening of the wellbore may be performed using a wellbore tool commonly referred to as a "toe sleeve" or "initiator sleeve," which is commonly located at the toe of the casing string. After pressure testing the casing integrity, the wellbore may be re-opened and further downhole operations may occur.

While it may be desirable to test the casing using sufficiently high pressure to accurately assess the ability of the casing to perform under operating conditions, typical toe sleeves may require even higher pressures to re-open the wellbore after testing. In instances, such pressures may risk damage to the casing and/or run the risk of pressuring out (e.g. not being able to effectively open the toe sleeve as desired, for example without casing damage). For these and/or other reasons apparent to persons of skill, there may be a need for improved toe sleeves and methods of operation.

BRIEF DESCRIPTION OF THE DRAWINGS

Embodiments of the disclosure may be better understood by referencing the accompanying drawings.

DESCRIPTION

Figure 1:
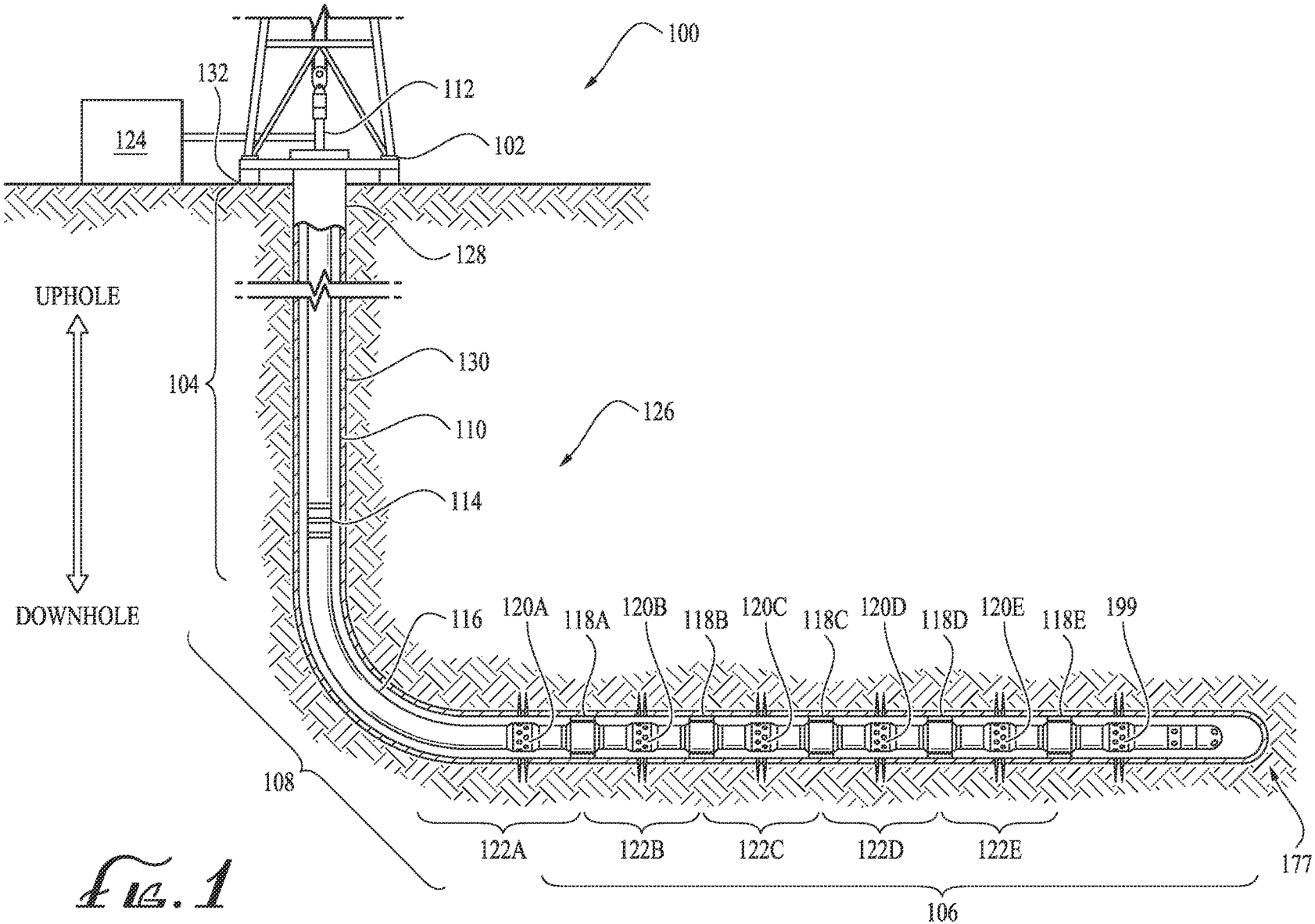
FIG. 1 illustrates a schematic elevation view of an exemplary well in which an exemplary tubular string (e.g. casing string) has been deployed, according to embodiments of this disclosure.

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

As used herein the terms "uphole", "upwell", "above", "top", "upper" and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. For example, the terms "uphole" and "downhole" may be used to describe the location of various components a well system 100 relative to the bottom, toe, or end of wellbore 128 shown in FIG. 1. For example, a first component described as uphole from a second component may be further away from the end/toe 177 of wellbore 128 (e.g. closer to the surface) than the second component. Similarly, a first component described as being downhole from a second component may be located closer to the end/toe 177 of wellbore 128 (e.g. further from the surface) than the second component. Terms like up, down, top, bottom, above, and below similarly relate to descriptions relative to uphole and downhole directions. Orientation terms "upstream" and "downstream" are defined relative to the direction of flow of fluid. "Upstream" is directed counter to the direction of flow of fluid, while "downstream" is directed in the direction of flow of fluid, as persons of skill will understand.

The present disclosure relates to toe sleeve embodiments having a closure mechanism requiring at least two different operations for opening. More specifically, the closure mechanism may include a degradable element and a non-degradable element. In embodiments, both the degradable and non-degradable elements may operate to maintain one or more ports in a housing of the toe sleeve closed (e.g. without fluid flow therethrough), and the one or more ports may only open if both the degradable and non-degradable elements are overcome (e.g. placed into open status). The degradable element may be configured to maintain closure of the toe sleeve during pressure testing (e.g. rated to high pressures associated with pressure testing of the casing), while the non-degradable element may be rated to open at a lower pressure once the degradable element has degraded (e.g. to release its retention). In embodiments, the toe sleeve may be configured so that the non-degradable element only experiences pressure forces (e.g. sufficient to place the non-degradable element into open status) after degradation of the degradable element. Thus, the degradable element may allow for pressure testing of the casing at high pressures (e.g. without opening the ports), but once the degradable element has degraded, the non-degradable element may be overcome to open the one or more ports using pressure lower than that required for pressure testing (e.g. significantly lower, for example at least an order of magnitude lower) and/or lower (e.g. at least 1000 psi lower) than the collapse/burst pressure of the casing. In this way, the disclosed toe sleeve embodiments may allow for effective casing pressure testing without concerns regarding damaging the casing during opening or being unable to open the toe sleeve without damage to the casing.

In some embodiments, the toe sleeve may further comprise a sleeve, which may typically be an inner sleeve having a first and a second position with respect to the ports of the housing. For example, the second position may be axially offset from the first position. In embodiments, the degradable element and/or non-degradable element may hold the sleeve in its first position (e.g. until overcome). In embodiments, the degradable element and/or non-degradable element may be configured to seal the one or more ports. In embodiments, the non-degradable element may comprise a shearable element or a rupturable element. In embodiments, the degradable element may comprise a degradable material, for example being configured to degrade after sufficiently long exposure to a reactive fluid and/or condition.

FIG. 1 is a schematic illustration of an exemplary well system 100, for example following a multiple-zone completion operation. A wellbore 128 extends from a surface 132 and through a subterranean formation 126 (e.g. which may be expected to produce hydrocarbons or other fluids, for example with the formation 126 including a reservoir of hydrocarbon/formation fluids). In the embodiment shown in FIG. 1, the wellbore 128 has a substantially vertical section 104 and a substantially horizontal section 106, for example with vertical section 104 and horizontal section 106 being connected by a bend 108. Horizontal section 106 and/or vertical section 104 may extend through a hydrocarbon bearing subterranean formation 126. One or more casing strings 110 are inserted and cemented into the wellbore 128, for example to prevent fluids from entering the wellbore in an uncontrolled manner. Fluids may comprise any one or more of formation fluids (such as production fluids or hydrocarbons), water, mud, fracturing fluids, or any other type of fluid that may be injected into or received from subterranean formation 126.

Although the wellbore 128 shown in FIG. 1 is shown having vertical section 104 and horizontal section 106, in other embodiments the wellbore 128 may be substantially vertical (for example, substantially perpendicular to the surface 132), substantially horizontal (for example, substantially parallel to the surface 132), angularly directional, or may comprise any other combination of horizontal, vertical, and/or angularly directional sections. While a land-based system 100 is illustrated in FIG. 1, toe sleeves incorporating teachings of the present disclosure may be satisfactorily used with drilling equipment located on offshore platforms, drill ships, semi-submersibles, and drilling barges, etc. One or more casing strings 110 may extend into the wellbore 128 from a wellhead 112.

The exemplary well system 100 depicted in FIG. 1 is generally known as a closed wellbore in which one or more casing strings 110 are inserted, for example in vertical section 104, bend 108, and/or horizontal section 106, and cemented in place with a cement sheath 130 surrounding casing string 110. As used herein, the term "closed wellbore" refers to a wellbore comprising a substantially unperforated or unbroken cement sheath in which there is no substantial fluid flowing from the wellbore to the subterranean formation. In some embodiments, the wellbore 128 may be partially completed (for example, partially cased or cemented) and partially uncompleted (for example, uncased and/or uncemented). In other embodiments, the wellbore 128 may be at least partially open if casing strings 110 do not extend through bend 108 and/or horizontal section 106 of the wellbore 128.

The embodiment illustrated in FIG. 1 includes a top production packer 114 disposed in the vertical section 104 of the wellbore that seals against an innermost surface of the casing string 110. A tubular string 116 extends from wellhead 112 along the wellbore. In embodiments, tubular string 116 may be a casing string, a liner, a work string, a coiled tubing string, or other tubular string as will be appreciated by one of skill in the art with the benefit of this disclosure. In embodiments, tubing string 116 may also be used to inject fluids into the formation 126 via the wellbore. Tubular string 116 may include multiple sections that are coupled or joined together by any suitable mechanism to allow tubular string 116 to extend to a desired or predetermined depth in the wellbore.

Toe sleeve 199 may be configured for incorporation into tubular string 116 or another suitable tubular string. For example, toe sleeve 199 may be coupled to the bottom/toe of the casing 110. Although only one toe sleeve is depicted in FIG. 1, multiple toe sleeves may be utilized in a single wellbore. In such embodiment, outer housing 205 of the toe sleeve 199 may comprise a suitable connection (e.g., an internal or external threaded surfaces) to allow for its incorporation into tubular string 116. Other suitable connections will be known to those of skill in the art with the benefit of this disclosure. As shown in FIG. 1, in certain embodiments, toe sleeve 199 may be positioned on or about tubular string 116 at a location farthest from wellhead 112. In other words, toe sleeve 199 may be the first or initial tool on tubular string 116 and/or disposed in proximity to the toe 177 of the wellbore 128.

In certain embodiments, toe sleeve 199 may be incorporated into a plug and perforation system. In other embodiments, toe sleeve 199 may be incorporated into a multi-stage fracturing system. In these embodiments, various other downhole tools may be disposed along tubular string 116 as would be appreciated by one of skill in the art with the benefit of this disclosure. Such downhole tools may include, but are not limited to, barriers 118A-E (e.g. packers) and sleeves 120A-E (which may in some embodiments be similar to the toe sleeve 199 and/or may be configured with an open position and a closed position). Barriers 118A-E may engage the inner surface of the wellbore, for example in FIG. 1 the horizontal section 106, dividing the horizontal section 106 into a series of production zones 120A-F. In some embodiments, suitable barriers 118A-E include, but are not limited to packers (e.g., compression set packers, swellable packers, inflatable packers), cement, any other downhole tools, equipment, or devices for isolating zones, or any combination thereof.

In some embodiments, a surface pump can be coupled to a well flow control 124 or other element in fluid communication with the wellbore. The surface pump may be operational to deliver or receive fluid through the tubular string 116 and/or cased wellbore, for example by applying a positive or negative pressure. In embodiments, the pump can be disposed at the surface 132. In other embodiments, a pump may be disposed within the wellbore 128.

In some embodiments, the system 100 may include a (e.g. surface) control system. In some embodiments, the control system may be configured to receive data, for example from one or more sensor, to evaluate the data, and responsive to the evaluation, to control an element of the system 100 (such as the pump, which may provide pressure for pressure testing). The control system may include an information handling system (e.g. comprising one or more processor) and/or may be configured to receive data from one or more sensor configured to monitor/detect one or more parameters of the system. Data from the sensor(s) may be transmitted to and/or received by the information handling system, for example with the control system using the data to monitor and/or control one or more aspect of the system 100. In embodiments, the control system may be configured to communicate with sensors and/or other components of the system wirelessly and/or via wired connection.

An exemplary information handling system/control system, for example for use with or by an associated system 100 of FIG. 1, is set forth below, according to one or more aspects of the present disclosure. A processor or central processing unit (CPU) of the control system may be communicatively coupled to a memory controller hub (MCH) or north bridge. The processor may include, for example a microprocessor, microcontroller, digital signal processor (DSP), application specific integrated circuit (ASIC), or any other digital or analog circuitry configured to interpret and/or execute program instructions and/or process data. The processor may be configured to interpret and/or execute program instructions or other data retrieved and stored in any memory (which may for example be a non-transitory computer-readable medium, configured to have program instructions stored therein, or any other programmable storage device configured to have program instructions stored therein) such as memory or hard drive. Program instructions or other data may constitute portions of a software or application, for example application or data, for carrying out one or more methods described herein. Memory may include read-only memory (ROM), random access memory (RAM), solid state memory, or disk-based memory. Each memory module may include any system, device or apparatus configured to retain program instructions and/or data for a period of time (for example, non-transitory computer-readable media). For example, instructions from a software or application or data may be retrieved and stored in memory for execution or use by processor. In one or more embodiments, the memory or the hard drive may include or comprise one or more non-transitory executable instructions that, when executed by the processor, cause the processor to perform or initiate one or more operations or steps. The information handling system may be preprogrammed or it may be programmed (and reprogrammed) by loading a program from another source (for example, from a CD-ROM, from another computer device through a data network, or in another manner).

The data may include testing data (e.g. such as pressure), treatment data, geological data, fracture data, microseismic data, sensor data, or any other appropriate data. In one or more embodiments, the data may include data relating to testing/sampling plans. In one or more embodiments, the data may include geological data relating to one or more geological properties of the subterranean formation. For example, the geological data may include information on the wellbore, completions, or information on other attributes of the subterranean formation. In one or more embodiments, the geological data may include information on the lithology, fluid content, stress profile (e.g., stress anisotropy, maximum and minimum horizontal stresses), pressure profile, spatial extent, gamma radiation profile of the well, or other attributes of one or more rock formations in the subterranean zone. The geological data may include information collected from well logs, rock samples, outcroppings, microseismic imaging, or other data sources. In one or more embodiments, the data may include fracture data relating to fractures in the subterranean formation. The fracture data may identify the locations, sizes, shapes, and other properties of fractures in a model of a subterranean zone. The fracture data may include information on natural fractures, hydraulically-induced fractures, or any other type of discontinuity in the subterranean formation. The fracture data may include fracture planes calculated from microseismic data or other information. For each fracture plan, the fracture data may include information (for example, strike angle, dip angle, etc.) identifying an orientation of the fracture, information identifying a shape (for example, curvature, aperture, etc.) of the fracture, information identifying boundaries of the fracture, or any other suitable information. In embodiments, the data may include a gamma radiation profile/map of the well.

In embodiments, the sensor data may include data measured/detected by one or more sensors, for example with relation to one or more aspect of the tubular string 116 (e.g. tool string and/or casing string) and/or the system 100. For example, the sensor data may include pressure, temperature, flow rate, viscosity, contamination/particle count, strain, and/or fluid type (e.g. identifying the type of fluid, for example as mud and/or formation fluid). Data received by the control system (e.g. from one or more sensors) may be used to carry out operations with respect to the tool string and/or system 100. For example, the control system may evaluate the data and determine one or more action based on the evaluation. In some embodiments, the control system may automatically take action based on the evaluation.

The one or more applications may comprise one or more software applications, one or more scripts, one or more programs, one or more functions, one or more executables, or one or more other modules that are interpreted or executed by the processor. For example, the one or more applications may include a fracture design module, a reservoir simulation tool, a hydraulic fracture simulation model, or any other appropriate function block. The one or more applications may include machine-readable instructions for performing one or more of the operations related to any one or more embodiments of the present disclosure. The one or more applications may include machine-readable instructions for generating a user interface or a plot, for example, illustrating fracture geometry (for example, length, width, spacing, orientation, etc.), pressure plot, hydrocarbon production performance, pump performance. The one or more applications may obtain input data, such as treatment data, geological data, fracture data, or other types of input data, from the memory, from another local source, or from one or more remote sources (for example, via the one or more communication links). The one or more applications may generate output data and store the output data in the memory, hard drive, in another local medium, or in one or more remote devices (for example, by sending the output data via the communication link).

Memory controller hub may include a memory controller for directing information to or from various system memory components within the information handling system, such as memory, storage element, and hard drive. The memory controller hub may be coupled to memory and a graphics processing unit (GPU). Memory controller hub may also be coupled to an I/O controller hub (ICH) or south bridge. I/O controller hub is coupled to storage elements of the information handling system, including a storage element, which may comprise a flash ROM that includes a basic input/output system (BIOS) of the computer system. I/O controller hub is also coupled to the hard drive of the information handling system. I/O controller hub may also be coupled to an I/O chip or interface, for example, a Super I/O chip, which is itself coupled to several of the I/O ports of the computer system, including a keyboard, a mouse, a monitor (or other display) and one or more communications link. Any one or more input/output devices receive and transmit data in analog or digital form over one or more communication links such as a serial link, a wireless link (for example, infrared, radio frequency, or others), a parallel link, or another type of link. The one or more communication links may comprise any type of communication channel, connector, data communication network, or other link. For example, the one or more communication links may comprise a wireless or a wired network, a Local Area Network (LAN), a Wide Area Network (WAN), a private network, a public network (such as the Internet), a WiFi network, a network that includes a satellite link, or another type of data communication network.

Modifications, additions, or omissions may be made to the exemplary control system described herein without departing from the scope of the present disclosure. For example, any suitable configurations of components may be used. In embodiments, components of control system may be implemented either as physical or logical components. Furthermore, in some embodiments, functionality associated with components of control system may be implemented in special purpose circuits or components. In other embodiments, functionality associated with components of control system may be implemented in configurable general-purpose circuit or components. For example, components of control system may be implemented by configured computer program instructions. In embodiments, any processor embodiments (e.g. disposed within the tubular/tool string) may have one or more similar components and/or configuration to the description of the control system embodiments above.

The present disclosure relates to one or more toe sleeve embodiments comprising a housing having a bore and at least one port (e.g. extending from the bore radially to an exterior of the toe sleeve), and a sleeve configured with two positions with respect to the at least one port. In some embodiments, the sleeve may be disposed within the housing (although in other embodiments, the sleeve may be external to the housing). In embodiments, the toe sleeve may further include a degradable retention mechanism, for example configured to retain the sleeve in a first position of the two positions, and a non-degradable element/mechanism which may be configured to removably/releasably close the one or more port and/or to retain the sleeve in its first position. The toe sleeve embodiments may be disposed within a closed wellbore penetrating at least a portion of a subterranean formation. For example, the toe sleeve embodiments may be incorporated within a tubular string (e.g. casing string) disposed within the closed wellbore.

In embodiments, the toe sleeve may include a closed configuration (e.g. preventing fluid communication between the bore and the formation) and an open configuration (e.g. allowing fluid communication between the bore and the formation). For example, the sleeve of the toe sleeve may be configured to transition from a closed/first position to an open/second position, for example to establish a route of fluid communication between the closed wellbore and the subterranean formation. In certain embodiments, the sleeve may remain in the closed position during the performance of a casing integrity test to prevent fluid flow from the closed wellbore to the subterranean formation. In certain embodiments, after pressure testing of the casing, the sleeve may transition from the closed position to the open position, thereby initiating fluid flow between the closed wellbore and the subterranean formation.

Among the many potential advantages to the apparatuses, systems, and methods of the present disclosure, only some of which are alluded to herein, the apparatuses, systems, and methods of the present disclosure may facilitate the performance of casing integrity testing with minimal risk of exceeding test pressure or inadvertently opening the toe sleeve or being unable to open the toe sleeve without damage to the casing. In certain embodiments, the apparatuses, systems, and methods of the present disclosure may also facilitate interventionless means to create a flow path at the toe of a wellbore penetrating a subterranean formation.

Figure 2:
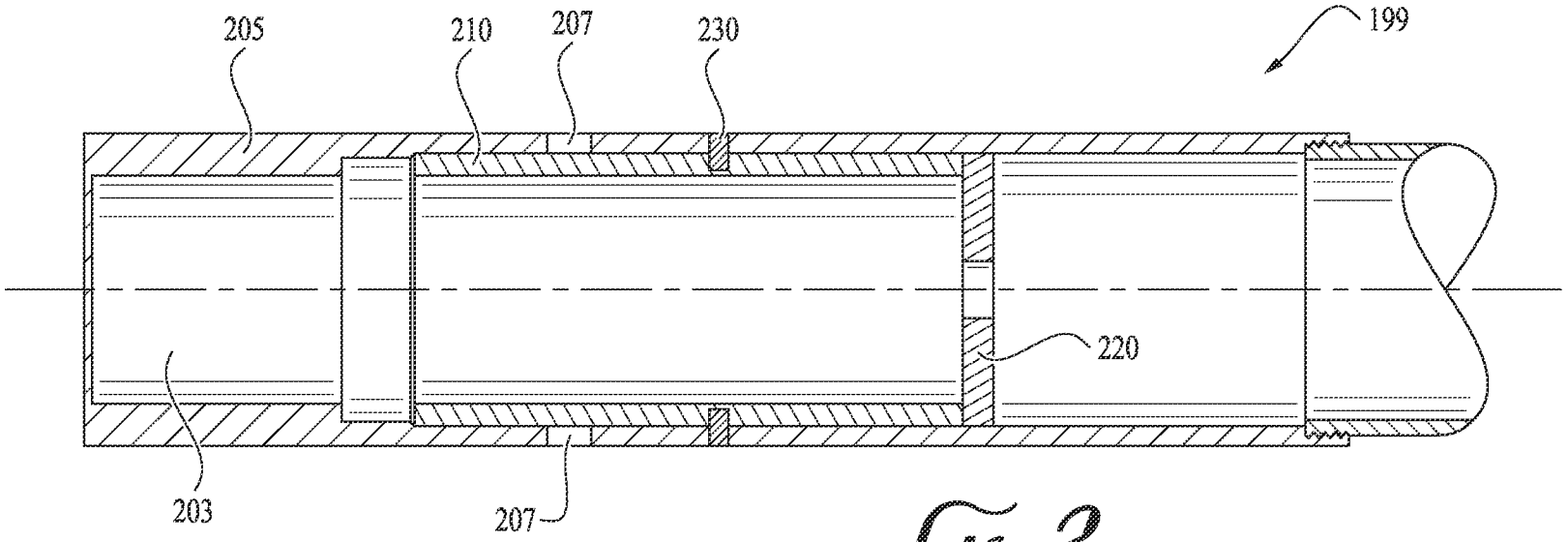
FIG. 2 illustrates schematically an exemplary toe sleeve tool, which may be used in a tubular string (e.g. casing string) such as that of FIG. 1, in a first configuration, according to an embodiment of this disclosure.
Figure 3:
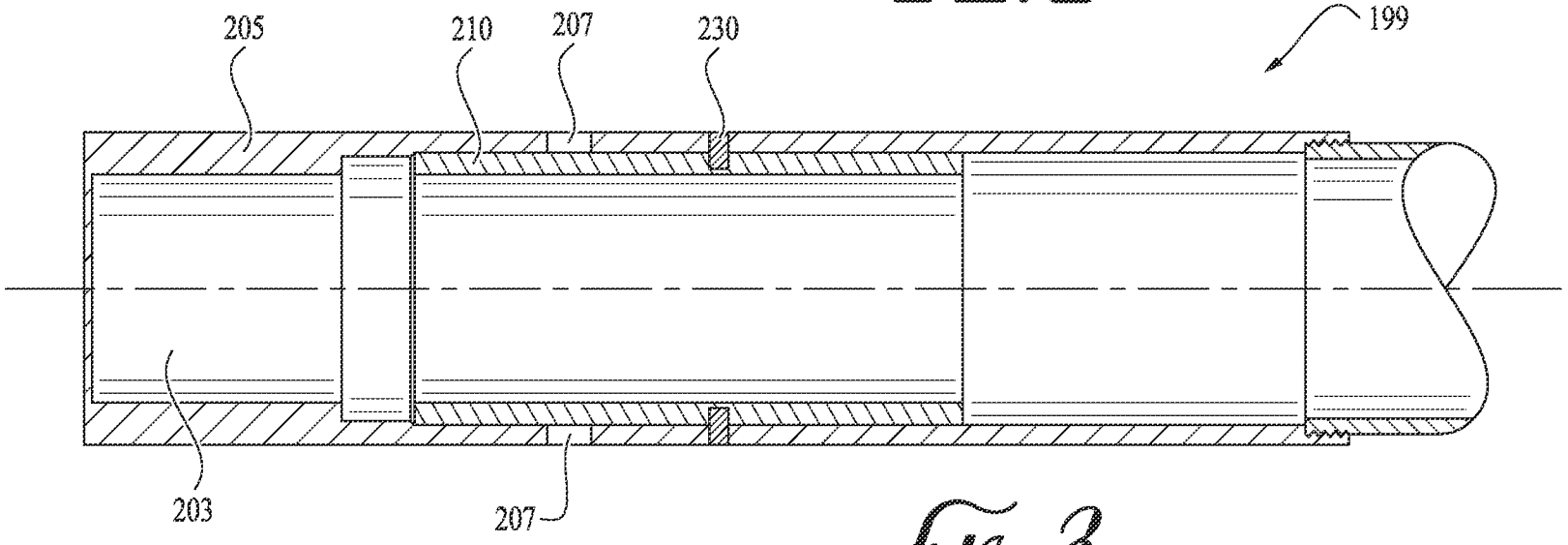
FIG. 3 illustrates schematically the toe sleeve of FIG. 2 in a second configuration, according to an embodiment of this disclosure.
Figure 4:
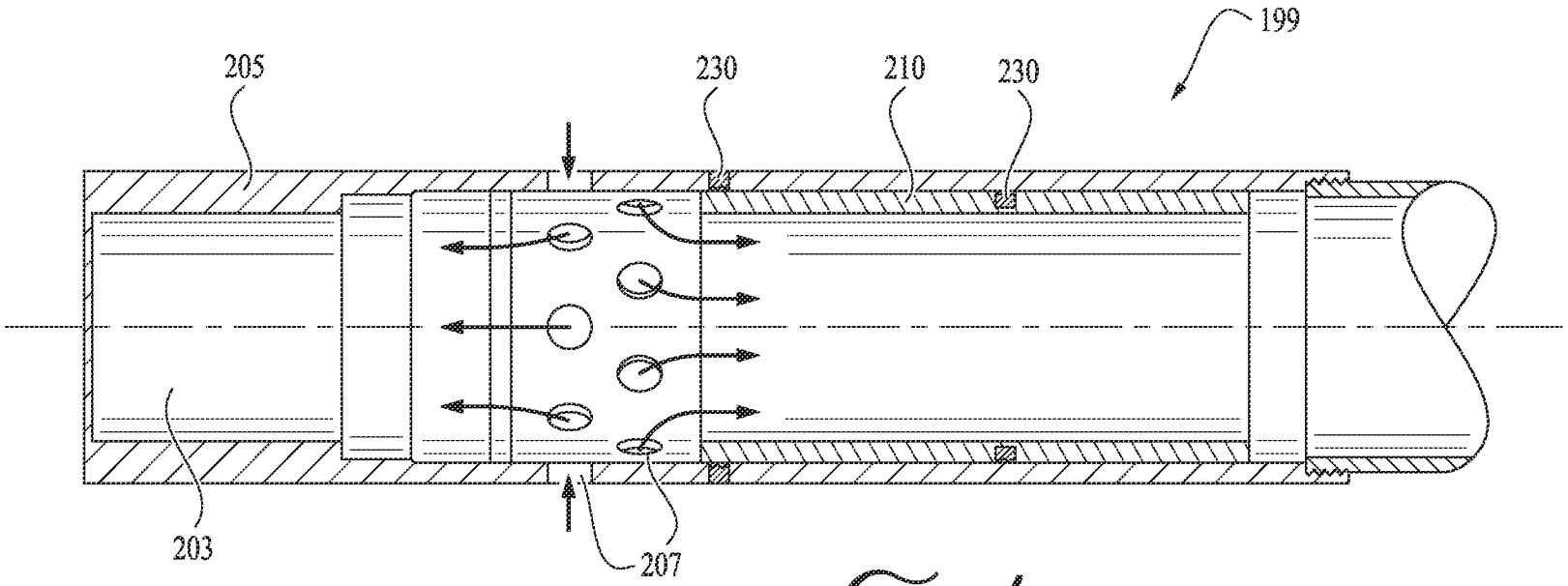
FIG. 4 illustrates schematically the toe sleeve of FIG. 2 in a third configuration, according to an embodiment of this disclosure.

Embodiments of the present disclosure and its advantages may be understood by referring to FIGS. 1 through 10, where like numbers are used to indicate like and corresponding parts. FIGS. 2-4 depict an exemplary toe sleeve 199 in accordance with certain embodiments of the present disclosure, for example with FIG. 2 depicting the toe sleeve 199 in a fully closed configuration (e.g. with both the degradable and non-degradable retention mechanisms holding the sleeve in its first/closed position), FIG. 3 depicting the toe sleeve 199 in a second, partially closed configuration (e.g. with the degradable retention mechanism degraded/released but the non-degradable retention element still holding the sleeve in its first/closed position), and FIG. 4 depicting the toe sleeve 199 in a third/open configuration (e.g. with both the degradable and non-degradable retention mechanisms overcome/released and the sleeve in its second/open position).

Figure 5:
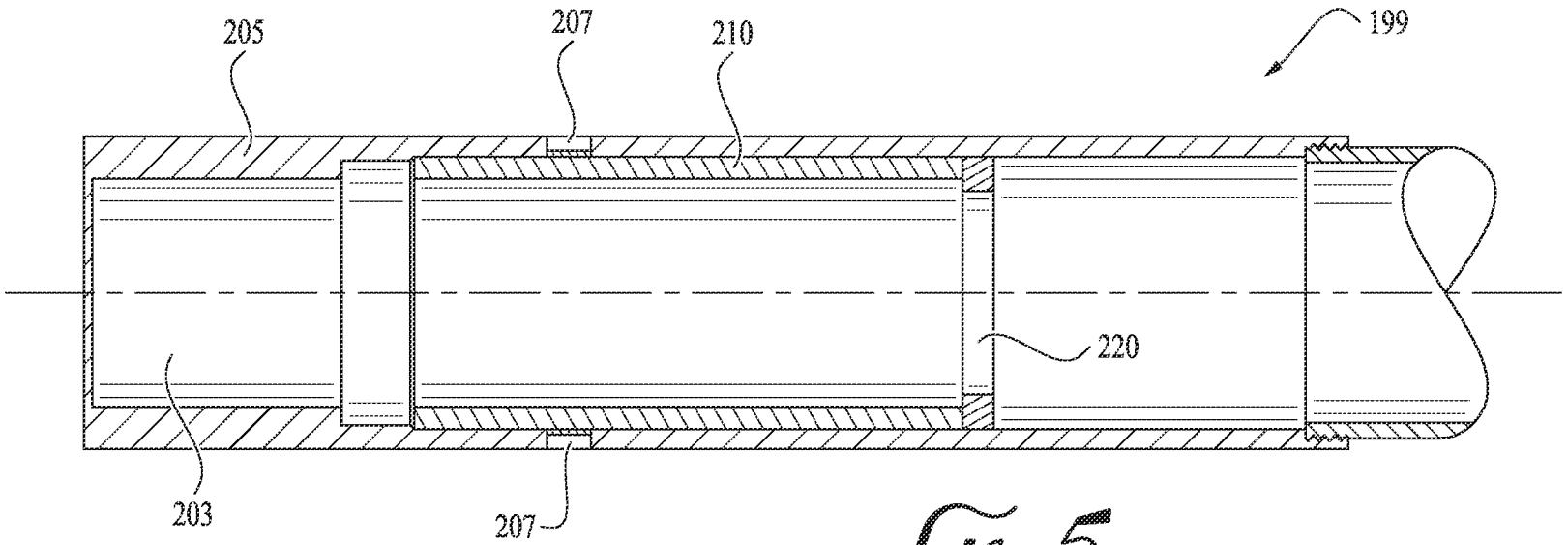
FIG. 5 illustrates schematically another exemplary toe sleeve tool, which may be used in a tubular string (e.g. casing string) such as that of FIG. 1, in a first configuration, according to an embodiment of this disclosure.
Figure 6:
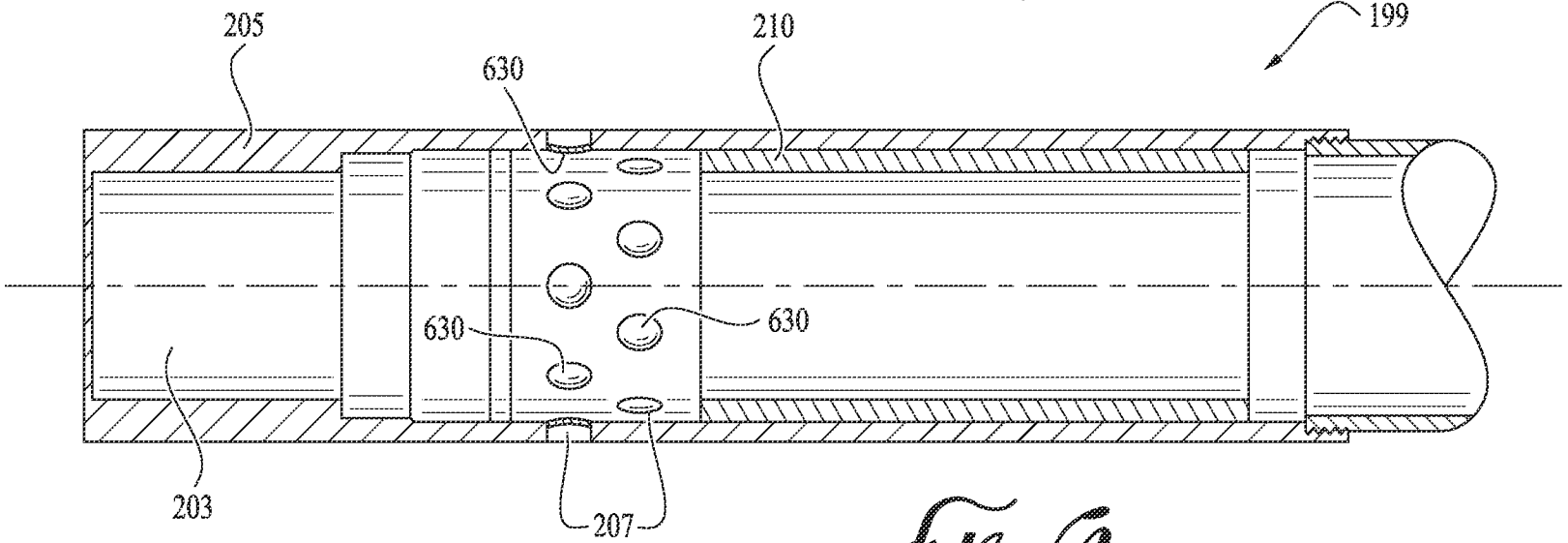
FIG. 6 illustrates schematically the toe sleeve of FIG. 5 in a second configuration, according to an embodiment of this disclosure.
Figure 7:
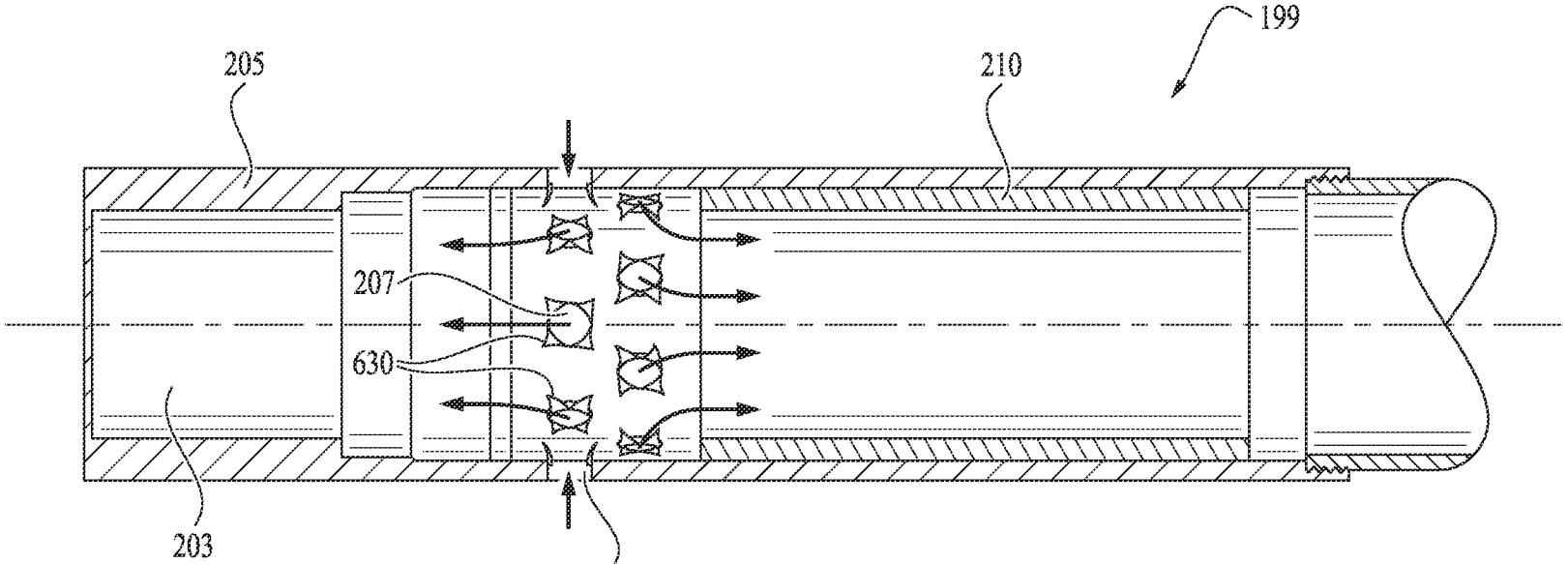
FIG. 7 illustrates schematically the toe sleeve of FIG. 5 in a third configuration, according to an embodiment of this disclosure.

Similarly, FIGS. 5-7 depict another exemplary toe sleeve 199 in accordance with certain embodiments of the present disclosure, for example with FIG. 5 depicting the toe sleeve 199 in a fully closed configuration (e.g. with both the degradable retention mechanism holding the sleeve in its first/closed position, and the non-degradable element (e.g. a rupturable port sealing element, such as a burst disc) closing the ports), FIG. 6 depicting the toe sleeve 199 in a second, partially closed configuration (e.g. with the degradable retention mechanism degraded/released to allow the sleeve to transition to its second position, but the non-degradable element still closing/sealing the ports), and FIG. 7 depicting the toe sleeve 199 in a third/open configuration (e.g. with both the degradable and non-degradable mechanisms overcome/released, the sleeve in its second/open position, and the ports open (e.g. the non-degradable element ruptured)).

Figure 8:
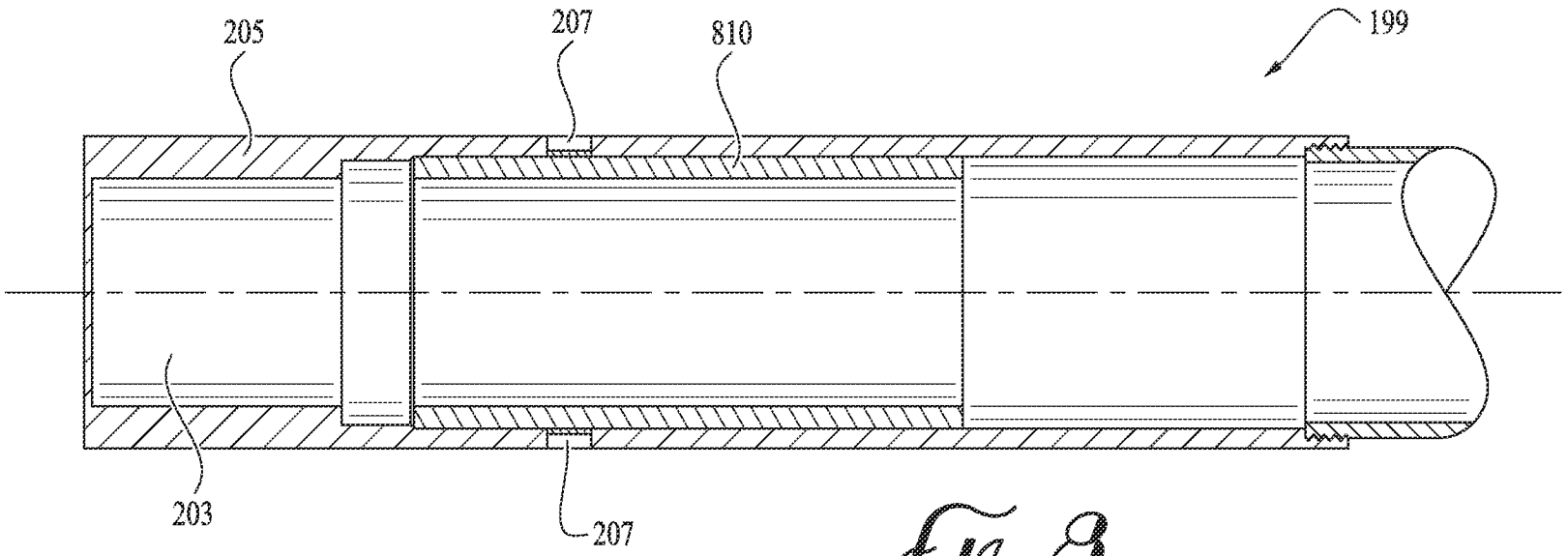
FIG. 8 illustrates schematically yet another exemplary toe sleeve tool, which may be used in a tubular string (e.g. casing string) such as that of FIG. 1, in a first configuration, according to an embodiment of this disclosure.
Figure 9:
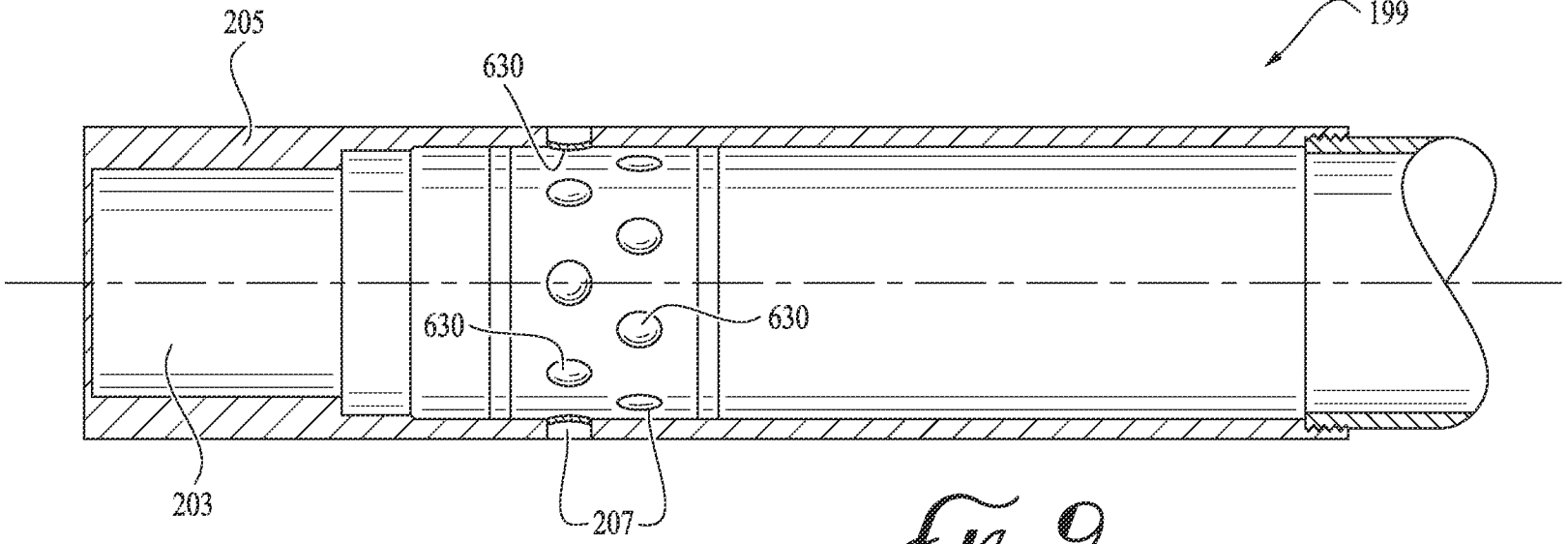
FIG. 9 illustrates schematically the toe sleeve of FIG. 8 in a second configuration, according to an embodiment of this disclosure.
Figure 10:
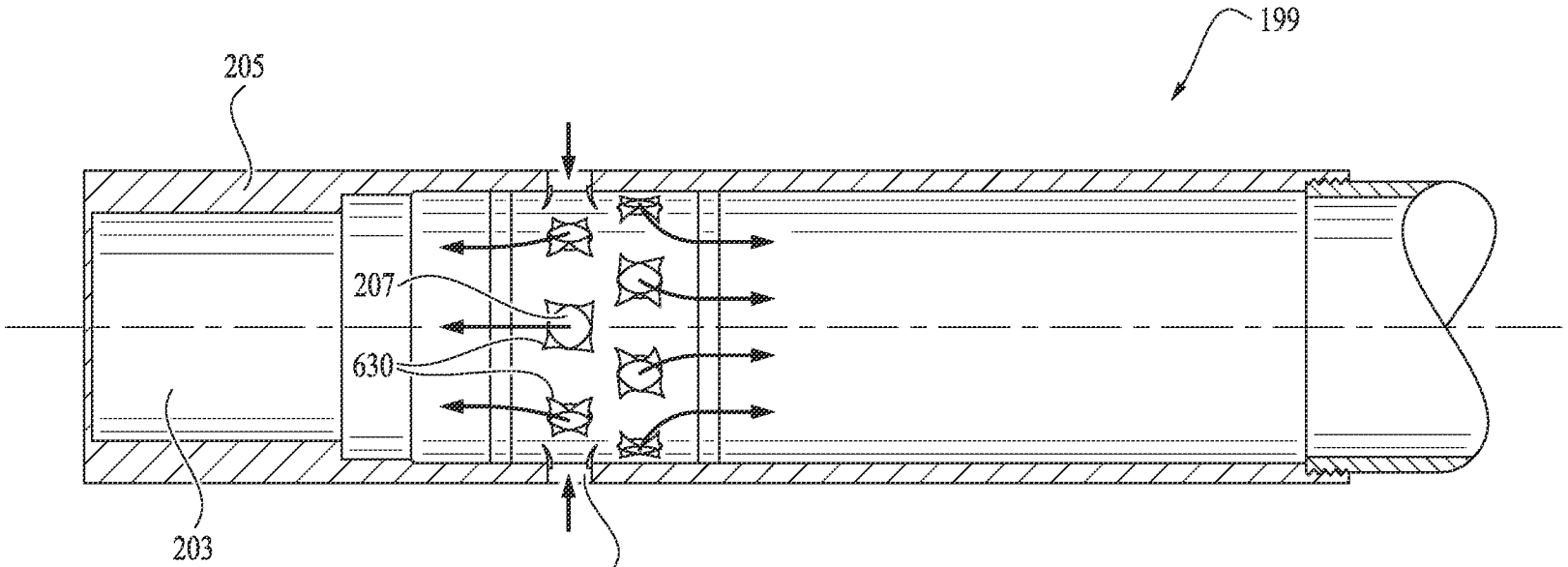
FIG. 10 illustrates schematically the toe sleeve of FIG. 8 in a third configuration, according to an embodiment of this disclosure.

Still another embodiment is shown in FIGS. 8-10, which depict an exemplary toe sleeve 199 in accordance with certain embodiments of the present disclosure. For example, FIG. 8 depicts the toe sleeve 199 in a fully closed configuration (e.g. with a degradable sleeve covering the ports and the non-degradable element (e.g. rupturable port sealing element, such as a burst disc) closing the ports), FIG. 9 depicting the toe sleeve 199 in a second, partially closed configuration (e.g. with the degradable sleeve degraded to expose the non-degradable element to the pressure of the bore, but the non-degradable element still closing/sealing the ports), and FIG. 10 depicting the toe sleeve 199 in a third/open configuration (e.g. with both the degradable sleeve gone/degraded and the non-degradable element overcome (e.g. ruptured) to open fluid communication between the bore and the formation). Such embodiments will be discussed in further detail below with respect to the figures.

FIG. 2 schematically illustrates an exemplary toe sleeve 199, having a housing 205 with a longitudinal bore 203 and one or more ports 207, and a sleeve 210 having a first/closed position and a second/open position (e.g. with respect to the one or more ports 207). The one or more ports 207 are configured so that, when open (e.g. responsive to the sleeve 210 being in the second/open position), the ports 207 may allow fluid communication therethrough, for example from an exterior environment such as the formation 126 surrounding the housing 205 to the bore 203. For example, the one or more ports 207 may extend radially through the wall of the housing 205, from the bore 203 to the exterior surface. The sleeve 210 may have unperforated walls or may be configured so that any perforations would be offset from the ports 207 when the sleeve 210 is in its first/closed position. In FIG. 2, the sleeve 210 may be disposed in the bore 203 of the housing 205 (e.g. concentrically disposed therein), such that the sleeve 210 may be an inner sleeve and the housing 205 may be an outer housing (e.g. as illustrated in FIG. 2).

In an embodiment, the toe sleeve 199 may further comprise a degradable retention mechanism 220, which may be configured to (e.g. removably) hold the sleeve 210 in its first/closed position (as shown in FIG. 2), and a non-degradable retention mechanism 230, which also may be configured to (e.g. removably) hold the sleeve 210 in its first (closed) position. By way of example, the degradable retention mechanism 220 may be configured to retain the sleeve 210 in its first/closed position for at least a specified exposure time (e.g. before degrading to release the sleeve 210) and/or may be configured to degrade when exposed to one or more degrading/reactive fluid and/or condition. In some embodiments, the degradable retention mechanism 220 may be a degradable collar (e.g. having a bore with an inner diameter), which may be configured to prevent axial movement of the sleeve 210 due to mechanical interference (e.g. axially contacting/abutting/supporting the sleeve 210, for example at its downhole end), or some other degradable element such as one or more degradable pin, screw, threads, etc., which may fix the axial position of the sleeve 210 with respect to the housing 205 (e.g. until sufficiently degraded).

In embodiments, the non-degradable retention mechanism 230 may comprise a shearable retention mechanism, for example having a pre-set opening/shear/release pressure (e.g. so that, when exposed to/experiencing the shear/opening pressure, the shearable element may shear to release its retention of the sleeve 210 with respect to the housing 205). In embodiments, the shearable retention mechanism may be configured to shear or break once the pressure inside toe sleeve 199 reaches a predetermined pressure. In embodiments, the non-degradable retention mechanism 230 may comprise one or more shear screws, shear pins, shear threads, etc. Typically, the non-degradable retention mechanism 230 is not exposed to shear/opening pressure until the degradable retention mechanism 220 has degraded (e.g. to release its retention of the sleeve 210). For example, until degraded, the degradable retention mechanism 220 may carry all or substantially all of the force generated by the pressure in the bore 203 (e.g. to prevent the non-degradable retention mechanism 230 from experiencing opening pressure). Additionally, the non-degradable retention mechanism 230 may typically be configured with its shear/opening pressure lower than the pressure which the degradable retention mechanism 220 can handle (e.g. while still maintaining retention). In other words, the degradable retention mechanism 220 may be configured to have its opening pressure (e.g. the pressure which would overcome the retention of the sleeve 210 by the degradable retention mechanism 220) be higher (e.g. typically significantly higher, such as greater than approximately 20,000 psi absolute pressure or approximately 25,000-30,000 psi, approximately 22,000-50,000 psi, approximately 25,000-50,000 psi, or approximately 30,000-50,000 psi) than the opening/shear pressure for the non-degradable retention mechanism 230. In some embodiments, the degradable retention mechanism 220 may be configured to have its opening pressure be up to an absolute pressure (e.g. which may allow for differentially activated tools in some embodiments).

So for example, in FIG. 2 the degradable retention mechanism 220 may axially fix the sleeve 210 in its first/closed position (e.g. covering the one or more port 207) during pressure testing (e.g. resisting pressures during the pressure testing of the casing, which may be in proximity to the collapse/burst pressure for the casing 110). While the degradable retention mechanism 220 holds the sleeve 210 in its first position, the non-degradable retention mechanism 230 does not experience opening pressure (e.g. pressure sufficient to shear the degradable retention mechanism). After the degradable retention mechanism 220 (e.g. the degradable collar in FIG. 2) degrades (e.g. releases its retention of the sleeve 210), the sleeve 210 may still be axially fixed in its first/closed position by the non-degradable retention mechanism 230 (e.g. shear screws/pins, as shown in FIG. 3), with the non-degradable retention mechanism 230 bearing any pressure forces until opening/shear pressure is applied (e.g. in the bore 203). The opening/shear pressure of the non-degradable retention mechanism 230 may be less than the pressure testing pressure (e.g. less than collapse/burst pressure of the casing, typically significantly or substantially less (such as approximately 5,000 psi, approximately 3,000-5,000 psi, approximately 5,000-10,000 psi, approximately 5,000-7,500 psi, approximately 5,000 psi less that pressure testing, approximately 3,000-5,000 psi less that pressure testing, approximately 5,000-10,000 psi less that pressure testing, or approximately 5,000-7,500 psi less that pressure testing)), but typically may be greater than hydrostatic pressure of the well. When this opening pressure is applied (e.g. after degradation of the degradable retention mechanism 220), the sleeve 210 may shift axially to expose/open the ports 207 (e.g. as shown in FIG. 4).

In the first/closed position, the sleeve 210 may be configured to (e.g. sealingly) close the ports 207 (e.g. preventing fluid communication therethrough, for example between an exterior environment such as the formation and the bore), while in the second/open position, the sleeve 210 may be configured to expose/open the ports 207 (e.g. with no portion of the sleeve 210 blocking/covering the ports 207 or with at least a portion of the sleeve 210 not blocking the ports 207). For example, the second/open position may be axially disposed from the first/closed position. In embodiments, in the first/closed position, the sleeve 210 may extend axially to cover the length of the housing 205 having the ports 207 (e.g. with the sleeve 210 being axially aligned with the ports 207). When no longer retained (e.g. once the degradable retention mechanism 220 has degraded and the non-degradable retention mechanism 230 (e.g. one or more shearable retention mechanism, such as shear screws/pins) have been overcome/sheared), the sleeve 210 may be configured to move (e.g. shift axially, for example due to pressure differential and/or pressure applied in the bore 203) from the first/closed position to the second/open position (e.g. shown in FIG. 4), for example with the sleeve 210 axially clear of the ports 207 (e.g. no longer axially aligned with at least some of the ports 207, for example disposed entirely below the ports 207). In other embodiments (e.g. in which the sleeve 210 has perforations), movement of the sleeve 210 to the second/open position may align its perforations with the ports 207 in the housing 205 (e.g. in order to open the ports 207). In some embodiments, such movement of the sleeve 210 may comprise axial movement. In some embodiments, such movement may comprise rotational movement.

In embodiments, the degradable retention mechanism 220 can comprise one or more degradable (e.g. including dissolvable) material that will undergo degradation and/or dissolution and cause the degradable retention mechanism 220 to lose structural integrity in situ under ambient conditions within the wellbore. The degradation and/or dissolution may be the result of contact of the degradable material with an ambient wellbore fluid, contact of the degradable material with an activator/catalytic fluid or compound placed into the wellbore, the effect of ambient conditions (e.g., heat or corrosion) in the wellbore, or combinations thereof. Examples of suitable degradable materials include metals and alloys, polymers, composite materials, or combinations thereof. Suitable metals and alloys may include corrosive metals, such as magnesium and aluminum alloys. Suitable polymers include hydrophilic polymeric materials such as polylactic acid (PLA), polyglycolic acid (PGA), polycaprolactone (PCL), or combinations thereof. Composite materials include fiber reinforced composites having synthetic or natural fibers (e.g., cellulose) and a binder resin/matrix (e.g., a polymer such as PLA, PGA, or PCL).

In embodiments, the degradable retaining mechanism 220 may comprise one or more degradable material, such as a polymeric or metal alloy based degradable material. In some embodiments, the degradable material may comprise polymeric-based material, polymeric material that uses reinforcement particles or materials, and/or degradable metal alloys (such as Magnesium or Aluminum based alloys). In some embodiments, the degradable material may comprise a coating, for example providing a delay in degradation. In some embodiments, the degradable materials may comprise lactic acid, polylactic acid (PLA), PGA, and/or highly corrosive materials. In some embodiments, the reactive fluid for degrading the degradable material may comprise wellbore fluid, activator/catalytic fluid or compound, water, and/or mud. In some embodiments, the temperature of the reactive fluid may be controlled to cause or accelerate degradation. In some embodiments, the reactive fluid may have a high chlorine content.

In some embodiments, the degradable retention mechanism 220 may be configured to degrade (e.g. when exposed to reactive fluid and/or conditions) in more than 12 hours and/or in less than 5 days. In some embodiments, the degradable retention mechanism 220 may be configured to degrade (e.g. when exposed to reactive fluid and/or conditions) in more than 5 days (e.g. approximately 5-10 days, approximately 5-7 days, or approximately 7-10 days). In some embodiments, the degradable retention mechanism 220 may be configured to retain the sleeve 210 in the first/closed position during pressure testing of the well (for example, pressure testing of the casing 110). For example, the degradable retention mechanism 220 may be configured to resist (e.g. continue to retain the sleeve 220 in place) up to approximately 20,000 psi absolute pressure. In embodiments, the non-degradable retention mechanism 230 (e.g. shearable retention element, such as shear screws/pins) may be configured to retain the sleeve 210 in place until exposed to/experiencing (e.g. when the degradable retention mechanism 220 has degraded) a pre-set (e.g. shear/opening) pressure, which is typically lower than that for pressure testing (e.g. below the collapse/burst pressure of the casing) but greater than the hydrostatic pressure of the well.

FIG. 2 illustrates the toe sleeve 199 in its first/closed configuration, in which both the degradable retention mechanism 220 and non-degradable retention mechanism 230 retain the sleeve 210 in its first/closed position. FIG. 3 illustrates the toe sleeve 199 in its second (e.g. partially closed) configuration, in which the degradable retention mechanism 220 has released the sleeve 210 (e.g. due to degradation), but the non-degradable retention mechanism 230 still retains the sleeve 210 in its first/closed position. FIG. 4 illustrates the toe sleeve 199 in its third/open configuration, in which both the degradable retention mechanism 220 and non-degradable retention mechanism 230 have released the sleeve 210, allowing the sleeve 210 to move to its second/open position.

In embodiments, the combination of the non-degradable retention mechanism 230 (e.g. shear pins 118) with the degradable retention element 220 (e.g. degradable collar) may prevent sleeve 210 from prematurely transitioning from the closed position to the open position. For instance, in one embodiment, toe sleeve 199 may comprise one or more shear pins (e.g. as the non-degradable retention mechanism 230) and a degradable collar (e.g. as the degradable retention mechanism 220). In such embodiment, the degradable collar may be removed (e.g. degraded/dissolved, for example after completion of pressure testing of the casing) as described above, releasing its hold on sleeve 210 regarding transition from the closed position to the open position. However, the shear pins may continue to prevent sleeve 210 from transition to the open position until the pressure inside the toe sleeve 199 reaches a predetermined opening pressure that is sufficient to shear or break shear pins.

FIGS. 5-7 schematically illustrate another toe sleeve 199 embodiment. The toe sleeve 199 of FIG. 5 has a housing 205 (e.g. outer housing) and sleeve 210 (e.g. inner sleeve) similar to those described with respect to FIG. 2. For example, the housing 205 may have a longitudinal bore 203 and one or more ports 207, and the sleeve 210 (e.g. disposed in the bore 203) may have a first/closed position and a second/open position. A degradable retention mechanism 220 (such as a degradable collar, similar to that of FIG. 2) may be configured to hold the sleeve 210 in the first (closed) position (and rated to withstand pressures for pressure testing the casing/well). A rupturable sealing element 630 (such as a burst disc) may cover each port 207 and be configured with a burst/rupture/opening pressure to open the port 207 (e.g. serving as a non-degradable mechanism for closing the ports 207). Thus, the non-degradable element of FIG. 5 (e.g. configured to assist in maintain the ports 207 in a closed configuration, for example after degradation of the degradable retention mechanism 220) may comprise a rupturable sealing element 630 (e.g. rather than the shearable retention mechanism of FIG. 2).

The one or more ports 207 may be configured so that, when open (e.g. responsive to the sleeve 210 being in the second/open position and the rupturable sealing element 630 (e.g. burst disc) being ruptured), the ports 207 provide fluid communication therethrough, for example between an exterior environment such as the formation 126 and the bore 203. In the first/closed position (e.g. as shown in FIG. 5), the sleeve 210 may fluidly isolate the ports 207 with rupturable sealing element 630 (e.g. burst discs) from the bore 203, which may prevent fluid communication through the ports 207. For example, there may be a seal (such as an o-ring) between the exterior surface of the inner sleeve 210 and the interior surface of the outer housing 205. Thus, in the first/closed position, the sleeve 210 may (e.g. sealingly) close the ports (e.g. preventing fluid communication therethrough, for example between an exterior environment such as the formation and the bore). The sleeve 210 may also shield the rupturable sealing element 630 (e.g. burst discs) from opening pressure. The rupturable sealing element 230 (e.g. burst disc) typically may not be exposed to rupture/burst pressure (e.g. opening pressure) until the degradable retention mechanism 220 has degraded (e.g. to release its retention of the sleeve 210) and/or the sleeve 210 has shifted (for example, as discussed below with respect to FIGS. 5-6).

While FIG. 5 illustrates a first/closed configuration of the toe sleeve 199, FIG. 6 illustrates the toe sleeve 199 in its second/partially closed configuration. In FIG. 6, the sleeve 210 is in the second position (e.g. axially offset from the ports 207), so that the sleeve 210 exposes the ports 207/rupturable sealing element 630 to pressure in the bore 203. However, the rupturable sealing element 630 (e.g. burst discs) may continue to close/seal the ports 207 (e.g. preventing fluid flow therethrough). Typically, the rupturable sealing element 630 (e.g. burst discs) may be configured with a lower opening pressure (e.g. pressure/force to rupture the rupturable sealing element 630 and expose the ports 207) than the pressure rating of the degradable retention mechanism 220 (which typically is configured to handle pressure testing). Upon application of opening/rupture pressure (e.g. in the bore 203), the rupturable sealing element 630 (e.g. burst discs) may rupture/burst to open the ports 207, as shown in FIG. 7, thereby providing fluid communication therethrough. FIG. 7 illustrates a third (e.g. open) configuration for the toe sleeve 199.

FIGS. 8-10 schematically illustrate another toe sleeve 199 embodiment. The toe sleeve 199 of FIG. 8 has a housing 205 (e.g. outer housing) and sleeve 210 (e.g. inner sleeve) similar in many ways to those described with respect to FIGS. 2 and 5. For example, the housing 205 may have a longitudinal bore 203 and one or more ports 207. In some embodiment, the ports 207 may be closed/sealed by a rupturable sealing element 630 (e.g. burst discs). Similar to FIG. 5 above, the toe sleeve 199 of FIG. 8 may have rupturable sealing element 630 (e.g. burst discs) covering each port 207 and configured with a burst/rupture/opening pressure to open the port 207. However, the sleeve of FIG. 8 may be configured to be degradable, and may be fixed in place axially within the bore 203 to cover/seal/fluidly isolate the ports 207 (e.g. until degraded). The degradable sleeve 810 may be configured to isolate the ports 207 with rupturable sealing elements 630 (e.g. burst discs) from the bore 203 (and be rated to withstand pressures for pressure testing the casing/well—e.g. coupled to the housing 205 with sufficient strength to withstand pressure testing). In this embodiment, the degradable sleeve 810 may not have two axial positions, but may be securely and/or sealingly attached to the surface of the housing 205 (e.g. so as to close the ports 207 in the housing 205 until degraded, even during pressure testing).

The one or more ports 207 may be configured so that, when open (e.g. responsive to the degradable sleeve 810 being degraded/dissolved and the rupturable sealing element 630 (e.g. burst discs) being ruptured), the ports 207 provide fluid communication therethrough, for example between an exterior environment such as the formation and the bore. In FIG. 8, the degradable sleeve 810 fluidly isolates the ports 207 with rupturable sealing element 630 from the bore 203, which may prevent fluid communication through the ports 207 and/or prevent the rupturable sealing element 630 from experiencing pressure (e.g. opening/rupture pressure). For example, there may be a seal between the exterior surface of the degradable sleeve 810 and the interior surface of the housing 205. Thus, when the toe sleeve 199 is in its first/closed configuration (as shown in FIG. 8), the degradable sleeve 810 may (e.g. sealingly) close the ports 207 (e.g. preventing fluid communication therethrough, for example between an exterior environment such as the formation and the bore). The rupturable sealing element 630 (e.g. burst disc) may not be exposed to rupture pressure (e.g. opening pressure) until the degradable sleeve 810 has degraded (e.g. to expose the rupturable sealing element 630 to the bore 203), for example as discussed below with respect to FIGS. 9-10).

While FIG. 8 illustrates a first/closed configuration of the toe sleeve 199, FIG. 9 illustrates the toe sleeve 199 in its second/partially closed configuration. In FIG. 9, the degradable sleeve 810 has degraded and no longer closes/seals/isolates the ports 207, exposing the ports 207/rupturable sealing element 630 to pressure in the bore 203. However, the rupturable sealing element 630 (e.g. burst discs) continue to close/seal the ports 207 (e.g. preventing fluid flow therethrough). Typically, the rupturable sealing elements 630 (e.g. burst discs) may be configured with a lower opening pressure (e.g. rupture/burst pressure/force, for example to expose the ports 207 and/or rupture the burst discs) than the pressure rating of the degradable sleeve 810 (which typically is configured to withstand pressure testing until degraded). For example, the opening pressure for the rupturable sealing element 630 may be lower than the strength with which the degradable sleeve 810 is coupled to the housing 205. The rupturable sealing element 630 (e.g. the burst discs) may not be exposed to rupture pressure (e.g. opening pressure) until the degradable sleeve 810 has degraded (e.g. to expose the rupturable sealing element 630 to the bore 203, as shown in FIG. 9). Upon application of opening/rupture pressure (e.g. in the bore and/or to the rupturable sealing element 630), the rupturable sealing element 630 (e.g. burst discs) may rupture/burst to open the ports 207, as shown in FIG. 10, thereby providing fluid communication therethrough.

It should be understood that any embodiments referring to an inner sleeve and an outer housing are exemplary, and alternate embodiments having a sleeve and a housing (e.g. an outer sleeve and an inner housing) are also included within this disclosure. The examples illustrated in the figures are not limiting but exemplary, disclosing mechanisms, structures, and approaches that may be included in alternate embodiments having a sleeve and a housing. Regardless of any modifications, embodiments may be similar in other ways to the described and/or illustrated embodiments, for example sharing common features and/or overarching approach.

The operation of the toe sleeve 199 will now be described. In certain embodiments, toe sleeve 199 may be disposed within a closed wellbore 128 penetrating at least a portion of subterranean formation 126, as illustrated in FIG. 1. In certain embodiments, it may be desirable to test the integrity of casing string 110 in the closed wellbore 128 prior to establishing fluid communication between the closed wellbore 128 and subterranean formation 126. In such embodiments, the pressure inside the closed wellbore 128 may be increased, for example to pressure-testing pressure level (such as approximately 20,000 psi absolute pressure, or less than approximately 20,000 psi, such as approximately 10,000-20,000 psi or approximately 15,000-20,000 psi or approximately 17,000-20,000 psi or approximately 15,000-17,000 psi), for a period of time. One of skill in the art with the benefit of this disclosure will recognize appropriate pressures and time periods at which to test the integrity of casing string 110.

In certain embodiments, one or more wellbore conditions as described above may be adjusted following the casing integrity test. Various types of equipment may be located at well surface 132, well site 102, or within the wellbore 128. Such equipment may include, but is not limited to, a rotary table, completion, drilling, or production fluid pumps, tools or devices that can provide pressure and/or bleed off pressure, any tools or devices capable of generating an acoustic signal, fluid tanks and other completion, drilling, or production equipment. For example, well system 100 may include a well flow control 124. Well flow control 124 may include, without limitation, valves, sensors, instrumentation, tubing, connections, chokes, bypasses, any other suitable components to control fluid flow into and out of the wellbore 128, or any combination thereof. In operation, well flow control 124 controls the flow rate of one or more fluids. In one or more embodiments, an operator or well flow control 124 or both may regulate the pressure in the wellbore 128 by adjusting the flow rate of a fluid into the wellbore 128 (e.g. using a pump). Similarly, an operator or controller or both may adjust other wellbore conditions using various types of equipment located at the well surface 132, well site 102, or within the wellbore 128.

As described above, after degradation of the degradable retaining mechanism 220 or element, pressure may be applied to transition sleeve 210 from a closed position to an open position and/or to rupture a rupturable sealing element 630. In such embodiments, a route of fluid communication between the closed wellbore 128 and the subterranean formation 126 may be established through port(s) 207 of the toe sleeve 199. For example, this route of fluid communication may be an initial route of fluid communication. In certain embodiments, the route of fluid communication may break the cement sheath 130 to establish fluid flow between the wellbore 128 and subterranean formation 126. In certain embodiments, this may be the first or initial route of fluid communication established between the closed wellbore 128 to the subterranean formation 126, thereby opening the closed wellbore 128. In certain embodiments, a dissolvable plug may be exposed when sleeve 210 transitions from a closed position to an open position. In some embodiments, one or more dissolvable plug may be used, for example instead of a dissolvable sleeve, to fluidly isolate a rupturable sealing element 630 (e.g. burst discs). In embodiments, the dissolvable plug may be located in port(s) 207 of toe sleeve 199 (for example interior to the rupturable sealing element 630, such that the rupturable sealing element 630 may not be exposed to pressure in the bore until the dissolvable plug has dissolved). In embodiments, the dissolvable plug may be configured to close the ports 207 with sufficient strength to allow for effective pressure testing (e.g. be configured to resist the pressures associated with pressure testing). In such embodiments, the fluid in the wellbore 128 may at least partially dissolve the dissolvable plug before the route of fluid communication is established between the closed wellbore 128 and subterranean formation 126 and/or before exposure of the rupturable sealing element 630 to bore pressures. Once the cement sheath 130 is broken and/or an initial route of fluid communication is established between the closed wellbore 128 and subterranean formation 126, further wellbore operations (e.g., plug and perforation operations or ball drop operations) may commence.

During one or more wellbore operations, each of the sleeves 120A-E depicted in FIG. 1 may generally be operable between an open position and a closed position such that in the open position, the sleeves 120A-E allow communication of fluid between the tubular string 116 and the production zones 122A-E. In one or more embodiments, the sleeves 120A-E may be operable to control fluid in one or more configurations. For example, the sleeves 120A-E may operate in an intermediate configuration, such as partially open, which may cause fluid flow to be restricted, a partially closed configuration, which may cause fluid flow to be less restricted than when partially open, an open configuration which does not restrict fluid flow or which minimally restricts fluid flow, a closed configuration which restricts all fluid flow or substantially all fluid flow, or any position in between.

During production, fluid communication is generally from subterranean formation 126, through the sleeves 120A-E and toe sleeve 199 (for example, in an open configuration) and into tubular string 116. Communication of fluid may also be from tubular string 116, through the sleeves 120A-E and toe sleeve 199, and into the formation 126, as is the case during hydraulic fracturing. Hydraulic fracturing is a method of stimulating production of a well and generally involves pumping specialized fracturing fluids down the well and into the formation. As fluid pressure is increased, the fracturing fluid creates cracks and fractures in the formation and causes them to propagate through the formation. As a result, the fracturing creates additional communication paths between the wellbore 128 and the subterranean formation 126. Communication of fluid may also arise from other stimulation techniques, such as acid stimulation, water injection, and carbon dioxide ($CO_2$) injection.

Although well system 100 depicted in FIG. 1 comprises sleeves 120A-E and barriers 118A-E, it may comprise any number of additional downhole tools, including, but not limited to screens, flow control devices, slotted tubing, additional packers, additional sleeves, valves, flapper valves, baffles, sensors, and actuators. The number and types of downhole tools may depend on the type of wellbore, the operations being performed in the wellbore, and anticipated wellbore conditions. For example, in certain embodiments, downhole tools may include a screen to filter sediment from fluids flowing into the wellbore. In addition, although well system 100 depicted in FIG. 1 depicts fracturing tools, the methods and systems of the present disclosure may be used with any downhole tool or downhole operation.

Disclosed embodiments also include methods for using toe sleeve embodiments, such as the embodiments illustrated in FIGS. 2-10 and discussed herein. For example, a method for operating a toe sleeve (e.g. with a shearable retention mechanism and a degradable retention mechanism, similar to that discussed with respect to FIGS. 2-4), pressure testing the casing of a well, and/or operating (e.g. producing) a well may comprise: disposing the toe sleeve downhole in a well, wherein the toe sleeve is in a first/closed configuration (e.g. with the inner sleeve in a first/closed position); pressure testing the well/casing (e.g. at pressure above that necessary to shear the shearable retaining mechanism, but below the collapse/burst pressure of the casing), wherein the degradable retention mechanism prevents movement of the sleeve and/or shearing of the shearable retention mechanism; degrading the degradable retention mechanism (e.g. by exposure to reactive fluid and/or conditions) to release its retention of the sleeve (e.g. so that retention of the sleeve in the first position is only by the shearable retention mechanism, for example so that the shearable retention mechanism maintains the sleeve in its first position despite the degradation of the degradable retention mechanism); (e.g. after degradation of the degradable retention mechanism), pressurizing the toe sleeve (e.g. the bore) sufficiently to overcome/shear the shearable retention mechanism (e.g. by applying pressure greater than the shear/opening pressure); and moving/shifting the sleeve (e.g. axially) (e.g. from its first, closed position to its second, open position) to open/expose the ports in the housing (e.g. providing fluid communication therethrough, for example between the bore and the formation).

In embodiments, degrading the degradable retention mechanism may comprise exposing the degradable retention mechanism to one or more reactive fluid and/or condition. In embodiments, pressurizing the toe sleeve (e.g. bore) sufficiently to overcome/shear the shearable retention mechanism may comprise pressurizing the toe sleeve (e.g. pumping fluid downhole in the bore) to a pressure below that for pressure testing but above the retention/shear strength of the shearable retention mechanism (e.g. above the opening/shear pressure). In embodiments, shifting the sleeve axially may comprise driving the sleeve (e.g. downward) via pressure. Some embodiments may further comprise (e.g. after opening the ports) flowing formation fluid from the formation (e.g. exterior to the housing), through the ports, and into the bore (and typically then up the tool string to the surface). In some embodiments, flowing formation fluid may comprise pumping fluid, for example using a surface pump and/or downhole pump (such as an electrical submersible pump-ESP). Some embodiments may comprise flowing fluid from the bore through the open ports (e.g. into the formation, for example for fracturing). In embodiments, pressure testing may occur during the time before (e.g. complete) degradation. In embodiments, degrading may comprise exposure, for example to reactive fluid and/or conditions, for a time (e.g. an extended time, such as at least 12 hours, between approximately 12 hours to 5 days, greater than 5 days, or at least sufficient time to perform pressure testing of the well).

Disclosed embodiments may also relate to methods of making up a casing/tubing string (e.g. for pressure testing the casing of a well), which may include coupling a toe shoe (e.g. similar to that of FIGS. 2-4) to casing. In embodiments, the toe sleeve may be coupled to the toe/downhole end of the casing. Some embodiments may further comprise running the casing downhole in the well and/or cementing the casing within the wellbore. Some embodiments may further comprise degradably retaining (e.g. by degradable retention mechanism) the sleeve in its first/closed position. Some embodiments may further comprise non-degradably retaining (e.g. by non-degradable retention mechanism) the sleeve in the first/closed position, wherein the non-degradable retention is configured to withstand lower pressure than the degradable retention (e.g. opening/shearing pressure of the non-degradable retention mechanism is lower than the pressure for testing the casing and/or collapse/burst pressure for the casing, while the degradable retention mechanism is configured to withstand pressure testing while maintaining retention of the sleeve). Some embodiments may further comprise sealing between the sleeve and the housing, so that the non-degradable retention mechanism is not in fluid communication with the bore while the sleeve is in the first/closed position.

Disclosed embodiments also include methods for using toe sleeve embodiments, such as the embodiments illustrated in FIGS. 5-7 and discussed herein. For example, a method for operating a toe sleeve (e.g. with a rupturable sealing element and a degradable retention mechanism, similar to that discussed with respect to FIGS. 5-7), pressure testing the casing of a well, and/or operating (e.g. producing) a well may comprise: disposing the toe sleeve downhole in a well, wherein the toe sleeve is in its first/closed configuration (e.g. with the sleeve in its first position); pressure testing the well/casing (e.g. at pressure above that necessary to rupture the rupturable sealing element, but below the pressure for testing the casing and/or collapse/burst pressure of the casing), wherein the sleeve in its first position isolates/protects the rupturable sealing element from pressure in the bore (e.g. the pressure testing and/or preventing the rupturable sealing element from experiencing opening/rupture pressure) and/or the degradable retention mechanism is configured to hold the sleeve in its first position during pressure testing; degrading the degradable retention mechanism (e.g. by exposure to reactive fluid) to release the sleeve (e.g. so the axial movement of the sleeve is unrestrained); moving/shifting the sleeve (e.g. axially) from the first position (e.g. fluidly isolating the rupturable sealing element from the bore) to the second position (e.g. exposing the rupturable sealing element to the bore); pressurizing the toe sleeve (e.g. the bore) sufficiently to overcome/rupture the burst discs (e.g. to a pressure below the pressure testing but above the opening/rupture pressure of the rupturable sealing element); and opening the ports (e.g. to allow fluid flow therethrough).

In embodiments, degrading the degradable retention mechanism may comprise exposing the degradable retention mechanism to one or more reactive fluid and/or conditions. In embodiments, pressurizing the toe sleeve (e.g. bore) sufficiently to overcome/rupture the rupturable sealing element may comprise pressurizing the toe sleeve (e.g. pumping fluid downhole in the bore) to a pressure below that for pressure testing (e.g. below the collapse/burst pressure of the casing) but above the opening/rupture pressure of the rupturable sealing element (e.g. which is set below the pressure for pressure testing). In embodiments, shifting the sleeve axially may comprise driving the sleeve (e.g. downward) via pressure. Some embodiments may further comprise (e.g. after opening the ports) flowing formation fluid from the formation (e.g. exterior to the outer housing), through the ports, and into the bore (and typically then up the tool string to the surface). In some embodiments, flowing formation fluid may comprise pumping fluid, for example using a surface pump and/or downhole pump (such as an ESP). In embodiments, pressure testing may occur during the time before (e.g. complete) degradation. In embodiments, degrading may comprise exposure, for example to reactive fluid and/or conditions, for a time (e.g. an extended time, such as at least 12 hours, between approximately 12 hours to 5 days, greater than 5 days, or at least sufficient time to perform pressure testing of the well).

Disclosed embodiments may also relate to methods of making up a casing/tubing string (e.g. for pressure testing the casing of a well), which may include coupling a toe shoe (e.g. similar to that of FIGS. 5-7) to casing. Some embodiments may further comprise running the casing downhole in the well and/or cementing the casing within the wellbore. Some embodiments may further comprise degradably retaining (e.g. by degradable retention mechanism) the sleeve in its first/closed position. Some embodiments may further comprise sealing the one or more ports in the housing with a rupturable sealing element, wherein the rupturable sealing element is configured to withstand lower pressure than the degradable retention (e.g. the opening/rupture pressure of the rupturable sealing element may be lower than the pressure used for pressure testing). Some embodiments may further comprise sealing between the inner sleeve and the outer housing, so that the rupturable sealing element is not in fluid communication with the bore while the sleeve is in the first position.

Disclosed embodiments also include methods for using toe sleeve embodiments, such as the embodiments illustrated in FIGS. 8-10 and discussed herein. For example, a method for operating a toe sleeve (e.g. with a rupturable sealing element and a degradable sleeve, similar to that discussed with respect to FIGS. 8-10), pressure testing the casing of a well, and/or operating (e.g. producing) a well may comprise: disposing the toe sleeve downhole in a well, wherein the degradable sleeve (e.g. fluidly) isolates the ports with rupturable sealing element from the bore; pressure testing the well/casing (e.g. at pressure above that necessary to open/rupture the rupturable sealing element), wherein the degradable sleeve isolates/protects the rupturable sealing element from bore pressure and/or withstands pressure testing; degrading the degradable sleeve (e.g. by exposure to reactive fluid and/or conditions) to expose the ports with rupturable sealing element to the bore; pressurizing the toe sleeve (e.g. bore) sufficiently to rupture the rupturable sealing element (e.g. to a pressure below the pressure testing but above the opening/rupture pressure of the rupturable sealing element); and opening the ports to allow fluid flow therethrough.

In embodiments, degrading the degradable sleeve may comprise exposing the degradable retention mechanism to one or more reactive fluid and/or condition. In embodiments, pressurizing the toe sleeve (e.g. bore) sufficiently to rupture the rupturable sealing element may comprise pressurizing the toe sleeve (e.g. pumping fluid downhole in the bore) to a pressure below that for pressure testing but above the opening/rupture pressure of the rupturable sealing element. Some embodiments may further comprise (e.g. after opening the ports) flowing formation fluid from the formation (e.g. exterior to the outer housing), through the ports, and into the bore (and typically then up the tool string to the surface). In some embodiments, flowing formation fluid may comprise pumping fluid, for example using a surface pump and/or downhole pump (such as an ESP). In embodiments, pressure testing may occur during the time before (e.g. complete) degradation. In embodiments, degrading may comprise exposure, for example to reactive fluid and/or conditions, for a time (e.g. an extended time, such as at least 12 hours, between approximately 12 hours to 5 days, greater than 5 days, or at least sufficient time to perform pressure testing of the well).

Disclosed embodiments may also relate to methods of making up a casing/tubing string (e.g. for pressure testing the casing of a well), which may include coupling a toe shoe (e.g. similar to that of FIGS. 8-10) to casing. Some embodiments may further comprise running the casing downhole in the well and/or cementing the casing within the wellbore. Some embodiments may further comprise degradably closing/sealing/fluidly isolating (e.g. by degradable sleeve or other degradable element) the ports in the housing (e.g. fixing the degradable sleeve over the ports in the housing). Some embodiments may further comprise sealing the one or more ports in the housing with a rupturable sealing element, wherein the rupturable sealing element may be configured to withstand lower pressure than the degradable sleeve (e.g. the attachment of the degradable sleeve to the housing). Some embodiments may further comprise sealing between the degradable sleeve and the housing, so that the rupturable sealing element is not in fluid communication with the bore while the degradable sleeve is in place (e.g. while the sleeve is not degraded).

Persons of skill will understand these embodiments and related embodiments sharing one or more similarity therewith. For example, consider the following.

Additional Disclosure

The following are non-limiting, specific embodiments in accordance with the present disclosure:

In a first embodiment, a toe sleeve for use downhole in a well may comprise: a (e.g. outer) housing having a longitudinal bore and one or more ports; a (e.g. inner) sleeve (e.g. disposed in the bore) having a first/closed position and a second/open position; a degradable retention mechanism, configured to hold the sleeve in the first/closed position; and a non-degradable retention mechanism, configured to hold the sleeve in the first/closed position; wherein: the one or more ports are configured so that, when open (e.g. responsive to the sleeve being in the second/open position), the ports provide fluid communication therethrough (for example from an exterior environment such as annular space and/or the formation to the bore) and/or the one or more ports extend radially from the bore to an exterior of the housing; in the first/closed position, the sleeve (e.g. sealingly) closes the ports (e.g. prevents fluid communication therethrough, for example from an exterior environment such as annular space to the bore, and/or fluidly isolates the ports from the bore); in the second/open position, the sleeve exposes/opens the ports (allowing fluid communication therethrough); and the non-degradable retention mechanism is configured with a lower opening pressure than the degradable retention mechanism (e.g. the degradable retention mechanism is configured to withstand higher pressures than the non-degradable retention mechanism).

A second embodiment can include the toe sleeve of the first embodiment, wherein the non-degradable retention mechanism is not exposed to opening pressure until the degradable retention mechanism has degraded (e.g. to release its retention of the sleeve) (e.g. the sleeve in its first/closed position fluidly isolates the non-degradable retention mechanism from the bore and/or the degradable retention mechanism carries all or substantially all of the forces generated by the pressure until degraded) (e.g. the non-degradable retention mechanism does not experience forces from opening pressure until the degradable retention mechanism has degraded).

A third embodiment can include the toe sleeve of the first or second embodiment, wherein the degradable retention mechanism may be configured to retain the sleeve in its first/closed position for at least a specified exposure time (e.g. before degrading to release the sleeve) and/or may be configured to degrade when exposed to one or more degrading/reactive fluid and/or condition.

A fourth embodiment can include the toe sleeve of any one of the first to third embodiments, wherein the degradable retention mechanism comprises a degradable collar (e.g. configured to axially fix the sleeve, for example by interference).

A fifth embodiment can include the toe sleeve of any one of the first to fourth embodiments, wherein the non-degradable retention mechanism comprises a shearable retention mechanism.

A sixth embodiment can include the toe sleeve of the fifth embodiment, wherein the shearable retention mechanism comprises one or more shear screw, shear pin, shear thread, and/or combinations thereof.

A seventh embodiment can include the toe sleeve of any one of the first to sixth embodiments, wherein the non-degradable retention mechanism is configured with its shear/opening pressure lower than a pressure which the degradable retention mechanism can handle (e.g. while still maintaining retention).

An eighth embodiment can include the toe sleeve of any one of the first to seventh embodiments, wherein the degradable retention mechanism (e.g. axially) fixes the sleeve in its first/closed position (e.g. covering the one or more port) during pressure testing (e.g. resisting pressures during the pressure testing, which may be in proximity to the collapse/burst pressure for the casing) and/or prevents release of the non-degradable retention mechanism during pressure testing (e.g. prevents shearing of the shearable retention mechanism during pressure testing).

A ninth embodiment can include the toe sleeve of any one of the first to eighth embodiments, wherein after the degradable retention mechanism degrades (e.g. releases its retention of the sleeve), the sleeve is still fixed in its first/closed position by the non-degradable retention mechanism (e.g. the non-degradable retention mechanism is configured to continue to retain the sleeve in its first/closed position, after degradation of the degradable retention mechanism).

A tenth embodiment can include the toe sleeve of any one of the first to ninth embodiments, wherein the opening/shear pressure of the non-degradable retention mechanism is less than the pressure testing pressure.

An eleventh embodiment can include the toe sleeve of the tenth embodiment, wherein when this opening pressure is applied (e.g. after degradation of the degradable retention mechanism), the sleeve may shift (e.g. to its second/open position) to expose/open the one or more port.

A twelfth embodiment can include the toe sleeve of any one of the first to eleventh embodiments, wherein the second/open position is axially disposed from the first/closed position.

A thirteenth embodiment can include the toe sleeve of any one of the first to twelfth embodiments, wherein the degradable retention mechanism can comprise one or more degradable (e.g. including dissolvable) material.

A fourteenth embodiment can include the toe sleeve of the thirteenth embodiment, wherein degradation results from contact of the degradable material with an ambient wellbore fluid, contact of the degradable material with an activator/catalytic fluid or compound placed into the wellbore, the effect of ambient conditions (e.g., heat or corrosion) in the wellbore, or combinations thereof.

A fifteenth embodiment can include the toe sleeve of any one of the thirteenth to fourteenth embodiments, wherein the degradable materials includes metals and alloys, polymers, composite materials, or combinations thereof (for example, suitable metals and alloys may include one or more corrosive metal such as magnesium and aluminum alloys; suitable polymers may include one or more hydrophilic polymeric material such as polylactic acid (PLA), polyglycolic acid (PGA), polycaprolactone (PCL), or combinations thereof; and suitable composite materials may include fiber reinforced composites having synthetic or natural fibers (e.g., cellulose) and a binder resin/matrix (e.g., a polymer such as PLA, PGA, or PCL)).

A sixteenth embodiment can include the toe sleeve of any one of the third to fifteenth embodiments, wherein the reactive fluid for degrading the degradable material comprises wellbore fluid, activator/catalytic fluid or compound, water, and/or mud.

A seventeenth embodiment can include the toe sleeve of any one of the first to sixteenth embodiments, wherein the degradable retention mechanism is configured to degrade (e.g. when exposed to reactive liquid and/or conditions) in more than 12 hours and/or less than 5 days.

An eighteenth embodiment can include the toe sleeve of any one of the first to sixteenth embodiments, wherein the degradable retention mechanism is configured to degrade (e.g. when exposed to reactive liquid and/or conditions) in more than 5 days (e.g. approximately 5-10 days, approximately 5-7 days, or approximately 7-10 days).

A nineteenth embodiment can include the toe sleeve of any one of the first to eighteenth embodiments, wherein the degradable retention mechanism is configured to resist (e.g. continue to retain the sleeve in place) up to a pre-set (e.g. testing) pressure, up to an absolute pressure, or up to approximately 20,000 psi absolute pressure.

In a twentieth embodiment, a toe sleeve may comprise: a (e.g. outer) housing having a longitudinal bore and one or more ports; a (e.g. inner) sleeve (e.g. disposed in the bore) having a first position and a second position; a degradable retention mechanism, configured to hold the sleeve in the first position; and a rupturable sealing element covering/sealing each port and configured with an opening/rupture pressure to open the one or more ports; wherein: the one or more ports are configured so that, when open (e.g. responsive to the sleeve being in the second position and the rupturable sealing element being ruptured), the ports provide fluid communication therethrough, for example between an exterior environment such as annular space or the formation and the bore and/or the one or more ports extend radially from the bore to an exterior of the housing; in the first position, the sleeve fluidly isolates the ports with rupturable sealing element from the bore; in the second position, the sleeve exposes the ports/rupturable sealing element to pressure in the bore (e.g. the rupturable sealing element is exposed to pressure in the bore); and the rupturable sealing element is configured with a lower opening pressure than the pressure rating of the degradable retention mechanism (e.g. the degradable retention mechanism is configured to withstand higher pressures than the rupturable sealing element).

A twenty-first embodiment can include the toe sleeve of the twentieth embodiment, wherein the rupturable sealing element is not exposed to opening/rupture pressure until the degradable retention mechanism has degraded (e.g. to release its retention of the sleeve) and/or the sleeve has shifted (e.g. the sleeve in its first position fluidly isolates the rupturable sealing element from the bore).

A twenty-second embodiment can include the toe sleeve of any one of the twentieth to twenty-first embodiments, wherein the degradable retention mechanism is rated/configured to withstand pressures for pressure testing the casing/well.

A twenty-third embodiment can include the toe sleeve of any one of the twentieth to twenty-second embodiments, wherein the degradable retention mechanism is configured to retain the sleeve in its first position for at least a specified exposure time (e.g. before degrading to release the sleeve) and/or is configured to degrade when exposed to one or more degrading/reactive fluid and/or condition.

A twenty-fourth embodiment can include the toe sleeve of any one of the twentieth to twenty-third embodiments, wherein the rupturable sealing element comprises a burst disc.

A twenty-fifth embodiment can include the toe sleeve of any one of the twentieth to twenty-fourth embodiments, further comprising a seal (such as an o-ring) between the exterior surface of the inner sleeve and the interior surface of the outer housing.

A twenty-sixth embodiment can include the toe sleeve of any one of the twentieth to twenty-fifth embodiments, wherein upon application of opening/rupture pressure, the rupturable sealing element (e.g. burst discs) ruptures/bursts to open the one or more ports, for example thereby providing fluid communication therethrough.

A twenty-seventh embodiment can include the toe sleeve of any one of the twentieth to twenty-sixth embodiments, wherein the opening/rupture pressure of the rupturable sealing element is less than the pressure testing pressure.

A twenty-eighth embodiment can include the toe sleeve of any one of the twentieth to twenty-seventh embodiments, wherein the degradable retention mechanism comprises one or more degradable material.

A twenty-ninth embodiment can include the toe sleeve of the twenty-eighth embodiments wherein degradation results from contact of the degradable material with an ambient wellbore fluid, contact of the degradable material with an activator/catalytic fluid or compound placed into the wellbore, the effect of ambient conditions (e.g., heat or corrosion) in the wellbore, or combinations thereof.

A thirtieth embodiment can include the toe sleeve of any one of the twenty-eighth to twenty-ninth embodiments, wherein the degradable materials includes metals and alloys, polymers, composite materials, or combinations thereof (for example, suitable metals and alloys may include one or more corrosive metal such as magnesium and aluminum alloys; suitable polymers may include one or more hydrophilic polymeric material such as polylactic acid (PLA), polyglycolic acid (PGA), polycaprolactone (PCL), or combinations thereof; and suitable composite materials may include fiber reinforced composites having synthetic or natural fibers (e.g., cellulose) and a binder resin/matrix (e.g., a polymer such as PLA, PGA, or PCL)).

A thirty-first embodiment can include the toe sleeve of any one of the twenty-eighth to thirtieth embodiments, wherein the reactive fluid for degrading the degradable material may comprise wellbore fluid, activator/catalytic fluid or compound, water, and/or mud.

A thirty-second embodiment can include the toe sleeve of any one of the twentieth to thirty-first embodiments, wherein the degradable retention mechanism is configured to degrade (e.g. when exposed to reactive liquid and/or conditions) in more than 12 hours and/or less than 5 days.

A thirty-third embodiment can include the toe sleeve of any one of the twentieth to thirty-first embodiments, wherein the degradable retention mechanism may be configured to degrade (e.g. when exposed to reactive liquid and/or conditions) in more than 5 days (e.g. approximately 5-10 days, approximately 5-7 days, or approximately 7-10 days).

A thirty-fourth embodiment can include the toe sleeve of any one of the twentieth to thirty-third embodiments, wherein the degradable retention mechanism may be configured to resist (e.g. continue to retain the sleeve in place) up to a (e.g. testing) pressure, up to an absolute pressure, or up to approximately 20,000 psi absolute pressure.

In a thirty-fifth embodiment, a toe sleeve may comprise: a (e.g. outer) housing having a longitudinal bore and one or more ports; a rupturable sealing element covering/sealing each port and configured with an opening/rupture pressure to open the port; and a degradable (e.g. inner) sleeve (e.g. disposed in the bore) (or alternatively a degradable element, such as one or more dissolvable plug) configured to fluidly isolate the ports with rupturable sealing element from the bore; wherein: the one or more ports are configured so that, when open (e.g. responsive to the sleeve being dissolved and the rupturable sealing element being ruptured), the ports provide fluid communication therethrough, for example from an exterior environment such as annular space or formation to the bore and/or the one or more ports extend radially from the bore to an exterior of the housing; degrading the sleeve exposes the ports/rupturable sealing element to pressure in the bore; the rupturable sealing element is configured with a lower opening pressure than the pressure rating of the degradable sleeve (e.g. lower than the strength with which the sleeve is coupled to the outer housing, which typically is sufficient to withstand pressure testing); and the rupturable sealing element is not exposed to opening/rupture pressure until the degradable sleeve has degraded (e.g. to expose the rupturable sealing element).

A thirty-sixth embodiment can include the toe sleeve of the thirty-fifth embodiment, wherein the degradable sleeve is rated/configured to withstand pressures for pressure testing the casing/well (e.g. coupled to the housing with sufficient strength to withstand pressure testing).

A thirty-seventh embodiment can include the toe sleeve of any one of the thirty-fifth to thirty-sixth embodiments, wherein the sleeve is fixed in place within the bore to cover/seal/fluidly isolate the ports.

A thirty-eighth embodiment can include the toe sleeve of any one of the thirty-fifth to thirty-seventh embodiments, wherein the degradable sleeve is configured to isolate the ports with rupturable sealing element from the bore (e.g. so long as the degradable sleeve has not degraded, the rupturable sealing element is not in fluid communication with the bore and/or not exposed to opening pressure).

A thirty-ninth embodiment can include the toe sleeve of any one of the thirty-fifth to thirty-eighth embodiments, wherein the degradable sleeve is rated to withstand pressures for pressure testing the casing/well (e.g. coupled to the housing with sufficient strength to withstand pressure testing and/or to maintain fluid isolation of the rupturable sealing element during pressure testing).

A fortieth embodiment can include the toe sleeve of any one of the thirty-fifth to thirty-ninth embodiments, wherein the degradable sleeve may be configured to isolate the rupturable sealing element for at least a specified exposure time (e.g. before degrading to expose the rupturable sealing element to the bore) and/or may be configured to degrade when exposed to one or more degrading/reactive fluid and/or condition.

A forty-first embodiment can include the toe sleeve of any one of the thirty-fifth to fortieth embodiments, wherein the rupturable sealing element comprises a burst disc.

A forty-second embodiment can include the toe sleeve of any one of the thirty-fifth to forty-first embodiments, wherein the opening/rupture pressure of the rupturable sealing element is less than the pressure testing pressure.

A forty-third embodiment can include the toe sleeve of any one of the thirty-fifth to forty-second embodiments, further comprising a seal between the sleeve and the housing (e.g. between the exterior surface of the degradable inner sleeve and the interior surface of the outer housing).

A forty-fourth embodiment can include the toe sleeve of any one of the thirty-fifth to forty-third embodiments, wherein the degradable sleeve comprises one or more degradable material.

A forty-fifth embodiment can include the toe sleeve of the forty-fourth embodiment, wherein degradation results from contact of the degradable material with an ambient wellbore fluid, contact of the degradable material with an activator/catalytic fluid or compound placed into the wellbore, the effect of ambient conditions (e.g., heat or corrosion) in the wellbore, or combinations thereof.

A forty-sixth embodiment can include the toe sleeve of any one of the forty-fourth to forty-fifth embodiments, wherein the degradable materials includes metals and alloys, polymers, composite materials, or combinations thereof (for example, suitable metals and alloys may include one or more corrosive metal such as magnesium and aluminum alloys; suitable polymers may include one or more hydrophilic polymeric material such as polylactic acid (PLA), polyglycolic acid (PGA), polycaprolactone (PCL), or combinations thereof; and suitable composite materials may include fiber reinforced composites having synthetic or natural fibers (e.g., cellulose) and a binder resin/matrix (e.g., a polymer such as PLA, PGA, or PCL)).

A forty-seventh embodiment can include the toe sleeve of any one of the forty-fourth to forty-sixth embodiments, wherein the reactive fluid for degrading the degradable material may comprise wellbore fluid, activator/catalytic fluid or compound, water, and/or mud.

A forty-eighth embodiment can include the toe sleeve of any one of the thirty-fifth to forty-seventh embodiments, wherein the degradable sleeve is configured to degrade (e.g. when exposed to reactive liquid and/or conditions) in more than 12 hours and/or less than 5 days.

A forty-ninth embodiment can include the toe sleeve of any one of the thirty-fifth to forty-seventh embodiments, wherein the degradable sleeve is configured to degrade (e.g. when exposed to reactive liquid and/or conditions) in more than 5 days (e.g. approximately 5-10 days, approximately 5-7 days, or approximately 7-10 days).

A fiftieth embodiment can include the toe sleeve of any one of the thirty-fifth to forty-ninth embodiments, wherein the degradable sleeve is configured to resist (e.g. continue to retain the sleeve in place) up to a (e.g. testing) pressure, up to an absolute pressure, or up to approximately 20,000 psi absolute pressure.

In a fifty-first embodiment, a method for operating a toe sleeve (e.g. with a shearable retention mechanism and a degradable retention mechanism, similar to that discussed with respect to FIGS. 2-4 and/or the first to nineteenth embodiments), pressure testing the casing of a well, and/or operating (e.g. producing) a well may comprise: disposing the toe sleeve downhole in a well, wherein the toe sleeve is in a first/closed configuration (e.g. with the inner sleeve in a first/closed position); pressure testing the well/casing (e.g. at pressure above that necessary to shear the shearable retaining mechanism, but below the collapse/burst pressure of the casing), wherein the degradable retention mechanism prevents movement of the inner sleeve and/or shearing of the shearable retention mechanism; degrading the degradable retention mechanism (e.g. by exposure to reactive fluid and/or conditions) to release its retention of the sleeve (e.g. so that retention of the sleeve in the first position is only by the shearable retention mechanism, for example so that the shearable retaining mechanism maintains the sleeve in its first position despite the degradation of the degradable retention mechanism); (e.g. after degradation of the degradable retention mechanism), pressurizing the toe sleeve (e.g. the bore) sufficiently to overcome/shear the shearable retention mechanism (e.g. applying pressure greater than the shear/opening pressure); and moving/shifting the sleeve (e.g. axially) (e.g. from its first, closed position to its second, open position) to open/expose the ports in the outer housing (e.g. providing fluid communication therethrough, for example between the bore and the formation).

A fifty-second embodiment can include the method of the fifty-first embodiment, wherein degrading the degradable retention mechanism comprises exposing the degradable retention mechanism to one or more reactive fluid and/or condition.

A fifty-third embodiment can include the method of any one of the fifty-first to fifty-second embodiments, wherein pressurizing the toe sleeve (e.g. bore) sufficiently to overcome/shear the shearable retention mechanism may comprise pressurizing the toe sleeve (e.g. pumping fluid downhole in the bore) to a pressure below that for pressure testing (e.g. below the collapse/burst pressure of the casing) but above the retention/shear strength of the shearable retention mechanism (e.g. above the opening/shear pressure).

A fifty-fourth embodiment can include the method of any one of the fifty-first to fifty-third embodiments, further comprising (e.g. after opening the ports) flowing formation fluid from the formation (e.g. exterior to the outer housing), through the ports, and into the bore (and typically then up the tool string to the surface) or flowing fluid from the bore through the open ports (e.g. into the formation).

A fifty-fifth embodiment can include the method of any one of the fifty-first to fifty-fourth embodiments, wherein pressure testing occurs during the time before (e.g. complete) degradation.

A fifty-sixth embodiment can include the method of any one of the fifty-first to fifty-fifth embodiments, wherein degrading comprises exposure, for example to reactive fluid and/or conditions, for a sufficient time (e.g. an extended time, such as at least 12 hours, between approximately 12 hours to 5 days, greater than 5 days, or at least sufficient time to perform pressure testing of the well).

In a fifty-seventh embodiment, a method of making up a casing/tubing string (e.g. for pressure testing the casing of a well) may comprise: coupling a toe shoe (e.g. similar to that of FIGS. 2-4 and/or the first to nineteenth embodiments) to casing.

A fifty-eighth embodiment can include the method of the fifty-seventh embodiment, wherein the toe sleeve is coupled to the toe/downhole end of the casing.

A fifty-ninth embodiment can include the method of any one of the fifty-seventh to fifty-eighth embodiments, further comprising running the casing downhole in the well and/or cementing the casing within the wellbore.

A sixtieth embodiment can include the method of any one of the fifty-seventh to fifty-ninth embodiments, further comprising degradably retaining (e.g. by degradable retention mechanism) the sleeve in its first/closed position.

A sixty-first embodiment can include the method of any one of the fifty-seventh to sixtieth embodiments, further comprising non-degradably retaining the sleeve in the first/closed position, wherein the non-degradable retention is configured to withstand lower pressure than the degradable retention (e.g. opening/shearing pressure lower than the pressure for testing the casing and/or collapse/burst pressure for the casing).

A sixty-second embodiment can include the method of any one of the fifty-seventh to sixty-first embodiments, further comprising sealing between the sleeve and the housing, so that the non-degradable retention mechanism is not in fluid communication with the bore while the sleeve is in the first/closed position.

In a sixty-third embodiment, a method for operating a toe sleeve (e.g. with a rupturable sealing element and a degradable retention mechanism, similar to that discussed with respect to FIGS. 5-7 and/or the twentieth to thirty-fourth embodiments), pressure testing the casing of a well, and/or operating (e.g. producing) a well comprises: disposing the toe sleeve downhole in a well, wherein the toe sleeve is in its first/closed configuration (e.g. with the inner sleeve in its first position); pressure testing the well/casing (e.g. at pressure above that necessary to rupture the rupturable sealing element, but below the pressure for testing the casing and/or collapse/burst pressure of the casing), wherein the sleeve in its first position isolates/protects the rupturable sealing element from pressure in the bore (e.g. the pressure testing and/or preventing the rupturable sealing element from experiencing opening/rupture pressure); degrading the degradable retention mechanism (e.g. by exposure to reactive fluid) to release the sleeve (e.g. so the axial movement of the sleeve is unrestrained); moving/shifting the sleeve (e.g. axially) from the first position (e.g. fluidly isolating the rupturable sealing element from the bore) to the second position (e.g. exposing the rupturable sealing element to the bore); pressurizing the toe sleeve (e.g. the bore) sufficiently to overcome/rupture the rupturable sealing element (e.g. to a pressure below the pressure testing but above the opening/rupture pressure of the rupturable sealing element); and opening the ports (e.g. to allow fluid flow therethrough).

A sixty-fourth embodiment can include the method of the sixty-third embodiment, wherein degrading the degradable retention mechanism comprises exposing the degradable retention mechanism to one or more reactive fluid and/or conditions.

A sixty-fifth embodiment can include the method of any one of the sixty-third to sixty-fourth embodiments, wherein pressurizing the toe sleeve (e.g. bore) sufficiently to overcome/rupture the rupturable sealing element comprises pressurizing the toe sleeve (e.g. pumping fluid downhole in the bore) to a pressure below that for pressure testing (e.g. below the collapse/burst pressure of the casing) but above the opening/rupture pressure of the rupturable sealing element.

A sixty-sixth embodiment can include the method of any one of the sixty-third to sixty-fifth embodiments, further comprising (e.g. after opening the ports) flowing formation fluid from the formation (e.g. exterior to the outer housing), through the ports, and into the bore (and typically then up the tool string to the surface).

A sixty-seventh embodiment can include the method of any one of the sixty-third to sixty-sixth embodiments, wherein pressure testing occurs during the time before (e.g. complete) degradation.

A sixty-eighth embodiment can include the method of any one of the sixty-third to sixty-seventh embodiments, wherein degrading may comprise exposure, for example to reactive fluid and/or conditions, for a sufficient time (e.g. an extended time, such as at least 12 hours, between approximately 12 hours to 5 days, greater than 5 days, or at least sufficient time to perform pressure testing of the well).

In a sixty-ninth embodiment, a method of making up a casing/tubing string (e.g. for pressure testing the casing of a well) comprises: coupling a toe shoe (e.g. similar to that of FIGS. 5-7 and/or the twentieth to thirty-fourth embodiments) to casing.

A seventieth embodiment can include the method of the sixty-ninth embodiment, further comprising running the casing downhole in the well and/or cementing the casing within the wellbore.

A seventy-first embodiment can include the method of any one of the sixty-ninth to seventieth embodiments, further comprising degradably retaining (e.g. by degradable retention mechanism) the sleeve in its first/closed position.

A seventy-second embodiment can include the method of any one of the sixty-ninth to seventy-first embodiments, further comprising sealing the one or more ports in the housing with a rupturable sealing element, wherein the rupturable sealing element is configured to withstand lower pressure than the degradable retention (e.g. the opening/rupture pressure of the rupturable sealing element may be lower than the pressure used for pressure testing).

A seventy-third embodiment can include the method of any one of the sixty-ninth to seventy-second embodiments, further comprise sealing between the sleeve and the housing, so that the rupturable sealing element is not in fluid communication with the bore while the sleeve is in the first position.

In a seventy-fourth embodiment, a method for operating a toe sleeve (e.g. with a rupturable sealing element and a degradable sleeve, similar to that discussed with respect to FIGS. 8-10 and/or the thirty-fifth to fiftieth embodiments), pressure testing the casing of a well, and/or operating (e.g. producing) a well comprises: disposing the toe sleeve downhole in a well, wherein the degradable sleeve isolates the ports with rupturable sealing element from the bore; pressure testing the well/casing (e.g. at pressure above that necessary to open/rupture the rupturable sealing element), wherein the degradable sleeve isolates/protects the rupturable sealing element from bore pressure; degrading the degradable sleeve (e.g. by exposure to reactive fluid) to expose the ports with rupturable sealing element to the bore; pressurizing the toe sleeve (e.g. bore) sufficiently to rupture the rupturable sealing element (e.g. to a pressure below the pressure testing but above the opening/rupture pressure of the rupturable sealing element); and opening the ports to allow fluid flow therethrough.

A seventy-fifth embodiment can include the method of the seventy-fourth embodiment, wherein degrading the degradable sleeve comprises exposing the degradable retention mechanism to one or more reactive fluid and/or condition.

A seventy-sixth embodiment can include the method of any one of the seventy-fourth to seventy-fifth embodiments, wherein pressurizing the toe sleeve (e.g. bore) sufficiently to rupture the rupturable sealing element may comprise pressurizing the toe sleeve (e.g. pumping fluid downhole in the bore) to a pressure below that for pressure testing but above the opening/rupture pressure of the burst rupturable sealing element.

A seventy-seventh embodiment can include the method of any one of the seventy-fourth to seventy-sixth embodiments, further comprising (e.g. after opening the ports) flowing formation fluid from the formation (e.g. exterior to the outer housing), through the ports, and into the bore (and typically then up the tool string to the surface).

A seventy-eighth embodiment can include the method of any one of the seventy-fourth to seventy-seventh embodiments, wherein pressure testing occurs during the time before (e.g. complete) degradation.

A seventy-ninth embodiment can include the method of any one of the seventy-fourth to seventy-eighth embodiments, wherein degrading comprises exposure, for example to reactive fluid and/or conditions, for a sufficient time (e.g. an extended time, such as at least 12 hours, between approximately 12 hours to 5 days, greater than 5 days, or at least sufficient time to perform pressure testing of the well).

In an eightieth embodiment, a method of making up a casing/tubing string (e.g. for pressure testing the casing of a well) comprises: coupling a toe shoe (e.g. similar to that of FIGS. 8-10 and/or the thirty-fifth to fiftieth embodiments) to casing.

An eighty-first embodiment can include the method of the eightieth embodiment, further comprising running the casing downhole in the well and/or cementing the casing within the wellbore.

An eighty-second embodiment can include the method of any one of the eightieth to eighty-first embodiments, further comprising degradably closing/sealing/fluidly isolating (e.g. by degradable sleeve or other degradable element) the ports in the housing (e.g. fixing the degradable sleeve over the ports in the housing).

An eighty-third embodiment can include the method of any one of the eightieth to eighty-second embodiments, further comprising sealing the one or more ports in the housing with a rupturable sealing element, wherein the rupturable sealing element may be configured to withstand lower pressure than the degradable sleeve (e.g. the attachment of the degradable sleeve to the housing).

An eighty-fourth embodiment can include the method of any one of the eightieth to eighty-third embodiments, further comprising sealing between the degradable sleeve and the housing, so that the rupturable sealing element is not in fluid communication with the bore while the degradable sleeve is in place (e.g. while the sleeve is not degraded).

In an eighty-fifth embodiment, a toe sleeve comprises: a housing having a longitudinal bore and one or more ports extending radially from the bore to an exterior surface of the housing; and a mechanism for removably closing the ports having a degradable element and a non-degradable element (e.g, wherein to open the mechanism (e.g. allowing fluid flow through the ports), both the degradable and non-degradable element must be overcome).

An eighty-sixth embodiment can include the toe sleeve of the eighty-fifth embodiment, wherein initially the mechanism for removably closing the ports is configured to close the ports (e.g. the toe sleeve is in a first/closed configuration) .

An eighty-seventh embodiment can include the toe sleeve of any one of the eighty-fifth to eighty-sixth embodiments, wherein the degradable element is configured to prevent opening of the ports during pressure testing (e.g. to retain the toe sleeve in its first/closed configuration) and/or to fluidly isolate the non-degradable element from the bore (e.g. until the degradable element has degraded).

An eighty-eighth embodiment can include the toe sleeve of any one of the eighty-fifth to eighty-seventh embodiments, wherein the non-degradable element is configured so that, upon degradation of the degradable element, the non-degradable element continues to retain the ports as closed (for example with the toe sleeve in its second/partially-closed configuration).

An eighty-ninth embodiment can include the toe sleeve of any one of the eighty-fifth to eighty-eighth embodiments, wherein the non-degradable element is configured to open the ports by application (e.g. in the bore) of pressure above an opening pressure but below the pressure testing (e.g. after degradation of the degradable element, applying pressure above the opening pressure of the non-degradable element transitions the toe sleeve to its third/open configuration).

A ninetieth embodiment can include the toe sleeve of any one of the eighty-fifth to eighty-ninth embodiments, wherein the mechanism comprises a sleeve having a first/closed position and a second/open position.

A ninety-first embodiment can include the toe sleeve of the ninetieth embodiment, wherein the second position is axially disposed from the first position.

A ninety-second embodiment can include the toe sleeve of any one of the ninetieth to ninety-first embodiments, wherein the degradable element is configured to retain/hold the sleeve in the first position until degraded.

A ninety-third embodiment can include the toe sleeve of any one of the ninetieth to ninety-second embodiments, wherein the sleeve in the first position is configured to fluidly isolate the non-degradable element from the bore, and the sleeve in the second position is configured to expose the non-degradable element to bore pressure.

A ninety-fourth embodiment can include the toe sleeve of any one of the ninetieth to ninety-third embodiments, wherein the non-degradable element comprises a shearable element configured to retain the sleeve in the first position until the degradable element has degraded and the non-degradable element is exposed to opening/shear pressure, and wherein shearing of the non-degradable element allows the sleeve to move from the first/closed position to the second/open position, thereby opening the ports.

A ninety-fifth embodiment can include the toe sleeve of any one of the ninetieth to ninety-third embodiments, wherein the non-degradable element comprises a rupturable sealing element.

A ninety-sixth embodiment can include the toe sleeve of the ninety-fifth embodiment, wherein the rupturable sealing element is configured to seal the ports until the degradable element has degraded, the sleeve has moved, and/or the rupturable sealing element is exposed to sufficient/opening pressure in the bore (e.g. to rupture and open the ports).

A ninety-seventh embodiment can include the toe sleeve of any one of the ninety-fifth to ninety-sixth embodiments, wherein the degradable element is a degradable sleeve (e.g, wherein the sleeve is degradable).

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru-Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

The invention claimed is:

1. A toe sleeve for use downhole in a well comprises:

a housing having a longitudinal bore and one or more ports;

a sleeve having a closed position and an open position;

a degradable retention mechanism, configured to hold the sleeve in the closed position; and a non-degradable retention mechanism, configured to hold the sleeve in the closed position;

wherein:

the one or more ports each extend radially from the bore to an exterior of the housing;

in the closed position, the sleeve closes the ports;

in the open position, the sleeve exposes the ports, thereby allowing fluid communication therethrough;

the non-degradable retention mechanism is configured with a lower opening pressure than the degradable retention mechanism; and the degradable retention mechanism is configured to prevent movement of the sleeve and release of the non-degradable retention mechanism during pressure testing.

2. The toe sleeve of claim 1, wherein the degradable retention mechanism is configured to degrade when exposed to one or more reactive fluid for a specified exposure time.

3. The toe sleeve of claim 2, wherein the degradable retention mechanism is configured to degrade in more than 12 hours and less than 5 days of exposure.

4. The toe sleeve of claim 3, wherein the degradable retention mechanism is configured to resist up to approximately 20,000 psi absolute pressure.

5. The toe sleeve of claim 1, wherein the non-degradable retention mechanism comprises a shearable retention mechanism, and release of the non-degradable retention mechanism comprises shearing of the shearable retention mechanism.

6. A method for operating a well having a toe sleeve comprises:

disposing the toe sleeve of claim 5 downhole in the well with casing, wherein the sleeve is disposed in the closed position and fixed by the degradable retention mechanism and the non-degradable retention mechanism;

pressure testing the casing, wherein the degradable retention mechanism prevents movement of the sleeve and shearing of the shearable retention mechanism during pressure testing;

degrading the degradable retention mechanism, wherein upon being degraded, the degradable retention mechanism no longer retains the sleeve, but the shearable retaining mechanism maintains the sleeve in the closed position despite degradation of the degradable retention mechanism;

pressurizing the toe sleeve sufficiently to overcome the shearable retention mechanism; and moving the sleeve from the closed position to the open position to open one or more ports in an outer housing, allowing fluid communication therethrough.

7. The method of claim 6, wherein degrading the degradable retention mechanism comprises exposing the degradable retention mechanism to one or more reactive fluid and/or condition.

8. The method of claim 6, wherein pressurizing the toe sleeve sufficiently to overcome the shearable retention mechanism comprises pressurizing the toe sleeve to a pressure below that for pressure testing but above an opening pressure of the shearable retention mechanism.

9. The method of claim 6, wherein the well extends into a formation, further comprising flowing formation fluid from the formation, through the ports, and into a bore of the toe sleeve.

10. The toe sleeve of claim 1, wherein the housing comprises an outer housing and the sleeve comprises an inner sleeve disposed in the bore of the outer housing.

11. The toe sleeve of claim 1, wherein the opening pressure of the non-degradable retention mechanism is less than pressure applied during pressure testing, and wherein the degradable retention mechanism is configured to axially fix the sleeve in the closed position during pressure testing.

12. The toe sleeve of claim 1, wherein the open position is axially disposed from the closed position.

13. The toe sleeve of claim 12, wherein the degradable retention mechanism comprises a degradable collar configured to axially fix the sleeve.

14. The toe sleeve of claim 1, wherein the degradable retention mechanism comprises one or more degradable material.

15. The toe sleeve of claim 14, wherein the degradable material comprises one of the following: a corrosive metal, a hydrophilic polymeric material, or combinations thereof.

16. The toe sleeve of claim 14, wherein degradation of the degradable retention mechanism results from contact of the one or more degradable material with an ambient wellbore fluid, contact of the one or more degradable material with an activator/catalytic fluid or compound placed into the wellbore, the effect of ambient conditions in the wellbore, or combinations thereof.

17. The toe sleeve of claim 1, wherein the non-degradable retention mechanism is not exposed to opening pressure until the degradable retention mechanism has degraded.

18. The toe sleeve of claim 17, wherein after the degradable retention mechanism degrades, the sleeve remains fixed in the closed position by the non-degradable retention mechanism until application of opening pressure.

19. The toe sleeve of claim 1, wherein the non-degradable retention mechanism does not experience forces from opening pressure until the degradable retention mechanism has degraded.

20. The toe sleeve of claim 1, wherein the degradable retention mechanism is configured to fix the sleeve in the closed position during pressure testing.

* * * * *